US005351173A

United States Patent [19]

Byrne

[11] Patent Number: 5,351,173

[45] Date of Patent: Sep. 27, 1994

[54] RETRACTABLE ENERGY CENTER WITH LIGHTING

[76] Inventor: Norman R. Byrne, 2736 Honey Creek, N.E., Ada, Mich. 49301

[21] Appl. No.: 141,825

[22] Filed: Oct. 22, 1993

[51] Int. Cl.[5] ..... A47B 23/06

[52] U.S. Cl. ..... 362/127; 362/364; 362/365; 362/418; 362/427; 439/131

[58] Field of Search ..... 362/33, 127, 418, 364, 362/427, 365

[56] References Cited

U.S. PATENT DOCUMENTS

| | | | |
|---|---|---|---|
| 4,180,850 | 12/1979 | Bivens | 362/418 |
| 4,747,788 | 5/1988 | Byrne . | |
| 4,984,139 | 1/1991 | Goggia | 362/364 |
| 5,072,345 | 12/1991 | Goggia | 362/364 |

OTHER PUBLICATIONS

Brochure entitled "Retractable Power Center" from Byrne Electrical Specialists, Inc., undated.

Product bulletin from PANDUIT, No. WS-MFP-1. (No Date).

Brochure entitled "AMP FLEX-MODE Interconnect Modules for voice and data," dated Sep. 1991.

Brochure entitled "AMP FLEX-MODE Interconnect Modules for voice and data." dated Aug. 1990.

*Primary Examiner*—Carroll B. Dority

*Attorney, Agent, or Firm*—Varnum, Riddering, Schmidt & Howlett

[57] ABSTRACT

A retractable communications terminal center (100) for providing conveniently located voice/data terminals (202) is adapted to be mounted in a work surface (104) such as a desk top or similar article of furniture. The communications terminal center (100) is manually operable and includes a stationary upper housing (128) received within a slot (122) formed in the work surface. In addition, a manually movable and slidable carriage (170) is utilized to mount the communication terminal modules (202). In response to manually exerted forces on the carriage (170), the carriage can be extended upward into an open position. Relatively small bosses (228) extend laterally from lateral sides of the carriage (170) and provide a means to support the carriage (170) in its extended position, with the bosses (228) resting on lips (236) in the housing (128). Still further, ledges (230) are integrally formed on the lateral sides of the carriage (170) near the bottom portions thereof, so as to prevent any further additional movement of the carriage (170) upwardly relative to the housing (128).

27 Claims, 20 Drawing Sheets

RETRACTABLE ENERGY CENTER WITH LIGHTING

BACKGROUND OF THE INVENTION

1. Field of the Invention

The invention relates to energy centers and, more particularly, to energy centers having lighting and which are mountable in or to furniture assemblies, work benches and the like.

2. Description of Related Art

Efficient organization of devices requiring electrical power within an office, commercial, industrial or residential environment has been a historical problem. Such devices include lamps, typewriters and the like. More recently, this problem has been exacerbated by the proliferation of additional devices for communications, such as complex telephone stations, computers, video displays and the like. The primary problems associated with the efficient organization and use of such devices relates to the abundance of wiring arrays and the positioning of the energy-requiring devices within the environment, particularly in office environments.

Added to the numerous wires and general space problems in the office environment is a need for quality lighting. It is known, for example, to put lighting fixtures in shelving units above a work surface. However, many work surfaces are provided without overhead shelving units. Additionally, some users prefer a lighting source close to the work surface, such as a desk lamp. However, a traditional desk lamp provides one more electrical cord on top of the work surface and often takes up valuable work surface space.

The problems of convenience, efficiency and aesthetics have been addressed to some extent with respect to electrical receptacles. It is known to mount electrical receptacles on a work surface in a retractable manner so that power cords may easily be connected to the electrical receptacles above the work surface, but both the cords and the receptacles may be retracted below the work surface while maintaining power to the user devices.

One relatively substantial advance in the art relating to the mounting of electrical receptacles in a retractable manner in work surfaces and the like, is shown in the commonly owned Byrne U.S. Pat. No. 4,747,788 issued May 31, 1988. In the Byrne patent, a retractable power center includes a rectangular housing formed in the work surface with a clamping arrangement to secure the housing to the work surface. A lower extrusion is connected to a lower portion of the housing, and a manually moveable power carriage mounts the receptacles. In response to manual application of upward forces on the power carriage, the carriage may be raised upward into an extended, open position. Small bosses extending from the sides of the carriage, resting on the top portion of the housing, support the carriage in the extended, open position. In the open position, the user can energize desired electrical devices from the receptacles and then lower the carriage into a releasably secured, retractable position.

Although the Byrne patent represents a substantial advance with respect to retractable power centers mounted in work surfaces and the like, it can also be advantageous to employ a retractable communications and lighting center to address the problems of efficiency, safety, and convenience in an aesthetically pleasing design. It would also be advantageous to employ a relatively more simple construction.

SUMMARY OF THE INVENTION

An energy center according to the invention overcomes these and other limitations by providing a stationary housing means and a carriage means received within the housing means. The carriage means is received within the housing means and is vertically movable with respect to the housing means between a closed, retracted position and an extended, open position. A support means mounted to the carriage means abuts the housing means and supports the carriage means in the extended, open position when the carriage means is supported in the extended, open position. A lighting means for provides mounts to the carriage means and illumination in the vicinity of the energy center. A pivot means coupled to the lighting means and to the carriage means provides positional adjustment of the lighting means relative to the carriage means.

The work surface can further comprise a slot formed in the work surface with the stationary housing means adapted to be mounted within the slot whereby the lighting means is substantially hidden from view below the work surface when the carriage means is in the closed, retracted position. Alternatively, the work surface can include side or edge portions and the stationary housing means may be mounted to the work surface adjacent the side or edge portions.

A second support means may be mounted to the carriage means for supporting the carriage means in at least one vertically extended position intermediate the closed, retracted position and the extended, open position. Also, the energy center may further comprise limit means engageable with the pivot means for limiting positional adjustment of the lighting means relative to the carriage means. Locking means may be provided which are engageable with the pivot means for maintaining the lighting means in a pivoted position relative to the carriage means.

The stationary housing means may include an aperture through which the carriage means is extendable and the lighting means and the carriage means can form a substantially enclosed cover upon the aperture when the carriage means is in the closed, retracted position. The energy center may further comprise a cover mounted to the carriage means which provides at least a partial cover over the aperture when the carriage means is extended to a position other than the closed, retracted position.

One aspect of the energy center in accordance with the invention is characterized by the lighting means being pivotable by the pivot means through a single axis between a closed position and an open position wherein, when the lighting means is in its open position, it is at an angle of 90° relative to the closed position. Preferably, the single axis is perpendicular to the vertical movement of the carriage means. When the lighting means is in its open position, it may define an angle in the range of 90° to 180° relative to the dosed position.

The pivot means may comprise two orthogonal pivot axes, with the lighting means pivotable about both axes. Each of the two orthogonal pivot axes are preferably perpendicular to vertical movement of the carriage means. The pivot means may provide spherical rotation of the lighting means relative to the carriage means.

In one aspect of the invention, the carriage means can comprise a pair of carriages adjacent one another and received within the housing means for vertical movement therein between a closed, retracted position and an extended, open position. Also, the lighting means comprises a pair of lighting devices, each of which is coupled to a different one of the carriages through the pivot means and pivotably adjustable relative to its corresponding carriage.

Preferably, the energy center further comprises energizing means connected to the lighting means and extending through the carriage means for selectively connecting the lighting means to a source of external power.

In an alternative embodiment of an energy center according to the invention, the energy center comprises a stationary housing mounted within a slot extending through a work surface, the stationary housing having an aperture therethrough. An elongated carriage is received within the aperture and is vertically movable with respect to the housing between a closed, retracted position and an extended, open position. Detent means between side walls of the carriage and the housing selectively maintain the carriage in the extended, open position. A lighting element interconnects with an upper portion of the carriage for selectively providing illumination in the vicinity of the energy center. The lighting element is substantially hidden from view below an upper portion of the work surface when the carriage is in the closed, retracted position, and the lighting element is fully accessible to a user when the carriage is in the extended, open position.

Preferably, the energy center further comprises a first pivot element coupled to the lighting element and to the carriage to provide pivotable rotation of the lighting element relative to the carriage about at least a single axis of rotation when the carriage is in the extended, open position. Also preferably, the energy center comprises a first pivot element coupled to the lighting element and to the carriage and extending in an elongated manner to form a pitch axis of rotation for the lighting element relative to the carriage. A second pivot element coupled to the lighting element and to the carriage and extending perpendicular to the first pivot element can provide a roll axis of rotation for the lighting element relative to the carriage. The energy center can comprise a pivot element coupled to the lighting element and to the carriage and extending parallel to the vertical movement of the carriage which provides a yaw axis of rotation for the lighting element relative to the carriage.

The energy center can further comprise a second carriage received within the aperture positioned adjacent and parallel to the first carriage and movable with respect to the housing between a closed, retracted position and an extended, open position. A second lighting element interconnects with an upper portion of the second carriage for providing additional illumination in the vicinity of the energy center. The second lighting element is substantially hidden from view below an upper portion of the work surface when the second carriage is in the closed, retracted position, and the second lighting element is fully accessible to a user when the carriage is in the extended, open position.

BRIEF DESCRIPTION OF THE DRAWINGS

The invention will now be described with reference to the drawings in which.

DESCRIPTION OF THE PREFERRED EMBODIMENTS

Figure 1:
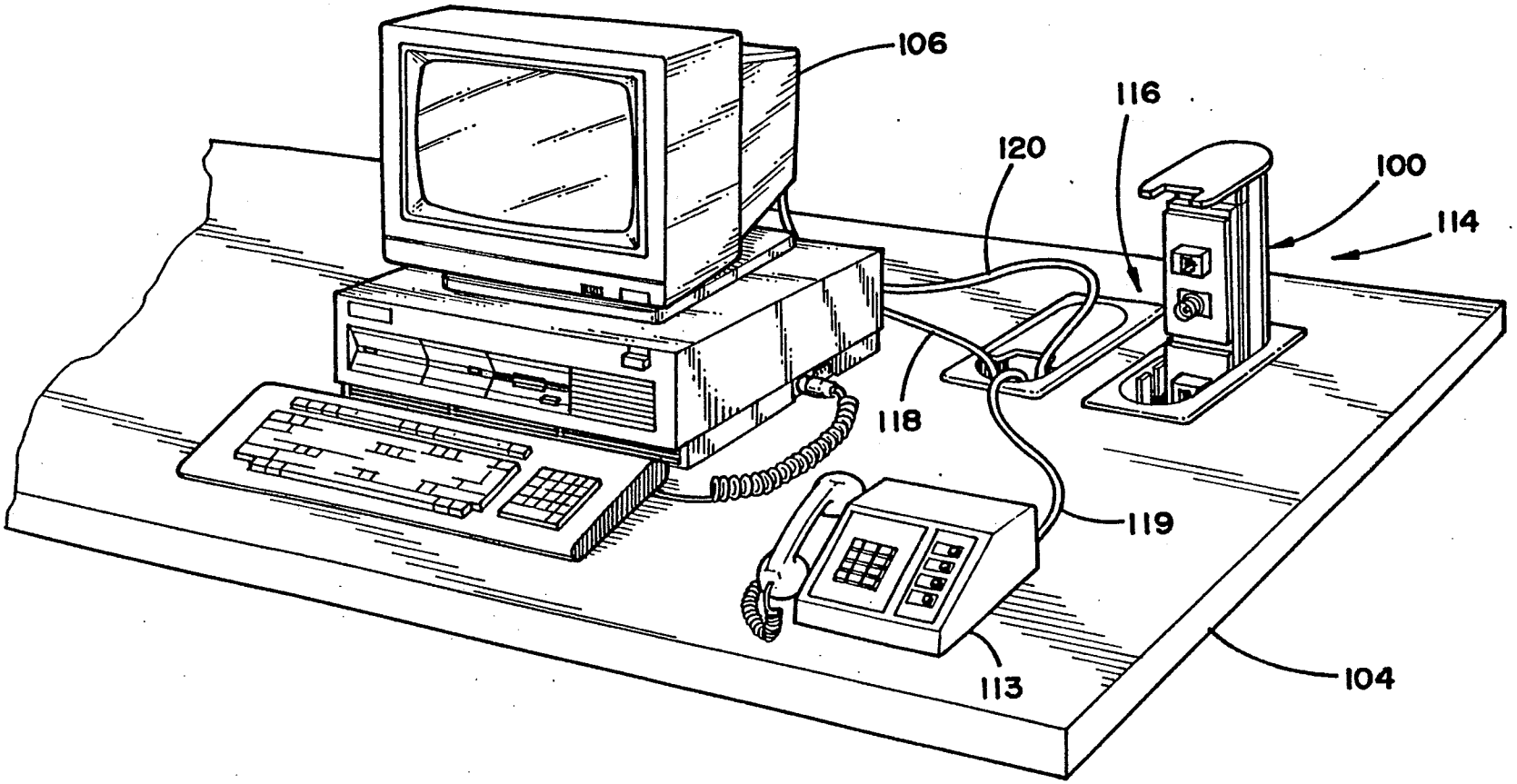
FIG. 1 is a perspective view of a work surface, telephone and computer apparatus employed with one embodiment of a retractable communications terminal center in accordance with the invention in a retracted position, and a similar embodiment of a retractable communications terminal center in accordance with the invention in an extended or open position.

An example of a manually-operable and retractable communications terminal center 100 is depicted in FIGS. 1–12. As shown in FIG. 1, the communications terminal center is adapted to be mounted within a furniture component such as the work surface 104, and further adapted to accept data lines from devices such as a computer apparatus 106 or telephone 108. The communications terminal center 100 is further adapted to be responsive to manually exerted forces so as to be extended upwardly into an open position as shown by the open position state 114 depicted in FIG. 1. When in this open and extended position, telephone jacks, computer cable connections or similar interconnections are fully accessible to the user for purposes of inserting cable terminals or the like from communications devices, such as the computer apparatus 106 or a telephone 108.

After insertion of appropriate cable terminals or the like, the communications terminal center 100 is further adapted to be responsive to manually exerted and downward forces so as to be easily retracted into a lowered position shown as the retracted position state 116 in FIG. 1. As also shown in FIG. 1, even while in this lower retracted position state 116, communications through cable terminals, telephone lines or the like can be maintained. For example, as specifically shown in FIG. 1, communications cables 118, 119, and 120 running from the computer apparatus 106 can be in communication while the communications terminal center 100 is in the retracted position state 116. In this state, the subsequently described communications terminals and other portions of the communications terminal center 100 are substantially hidden from view.

Still further, the communications terminal center 100 can be maintained in the retracted and lowered position state 116 when the communications terminal center 100 is not in use whatsoever. In addition, the communications terminal center 100 is adapted to be readily maintained in the open position state 114 with the use of relatively simple and inexpensive structure, and without requiring spring assemblies or any other types of relatively complex locking or clamping mechanisms. Finally, the communications terminal center 100 can be readily moved between the retracted position state 116 and the open position state 114 without requiring the use of any type of screwdrivers or similar tools.

Figure 4:
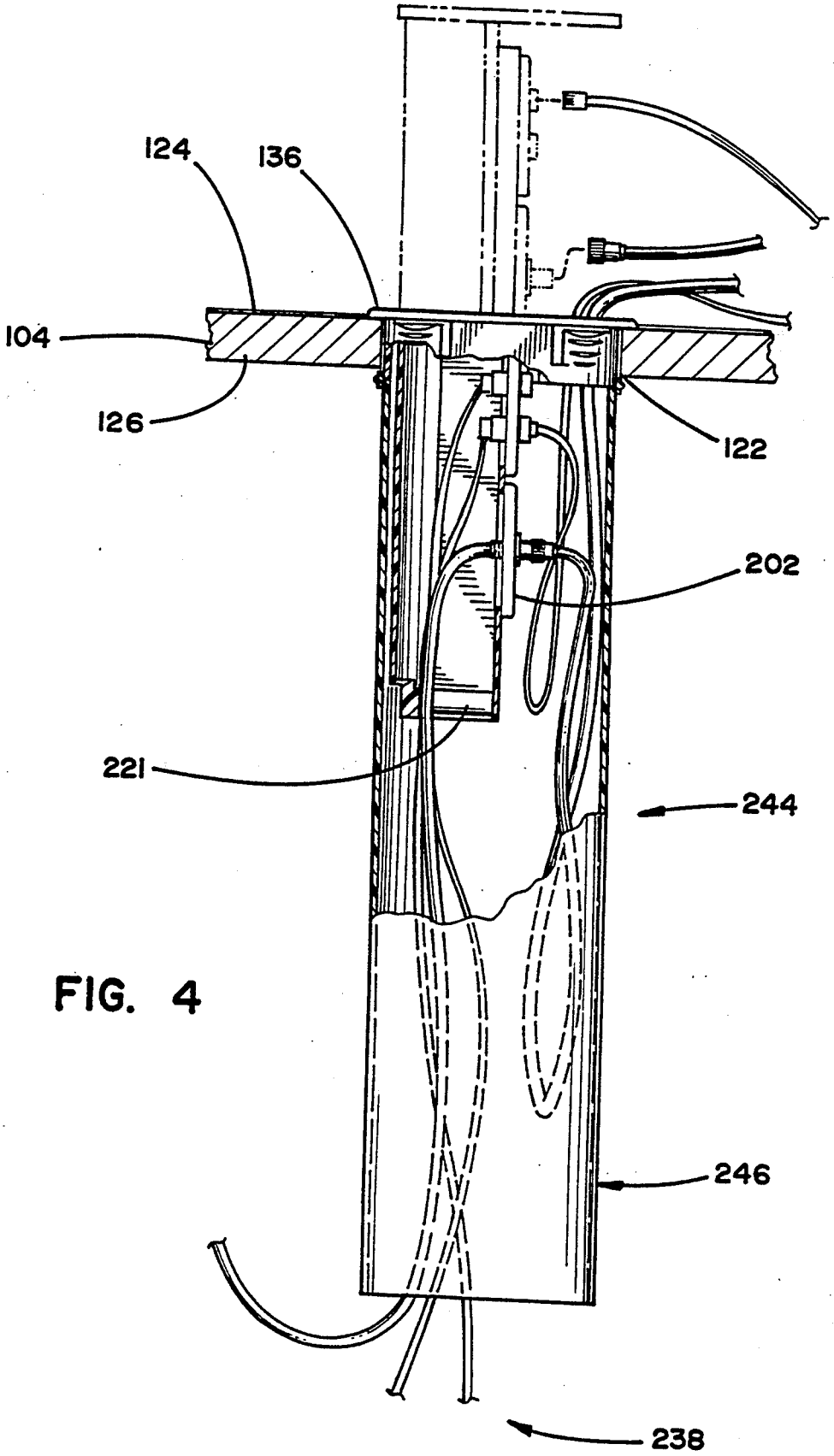
FIG. 4 is an elevation view in partial cross section of the retractable communications terminal center shown in FIGS. 2 and 3, with the communications terminal center mounted in a work surface and further showing a lower extrusion cover which can be utilized with the communications terminal center.
Figure 6:
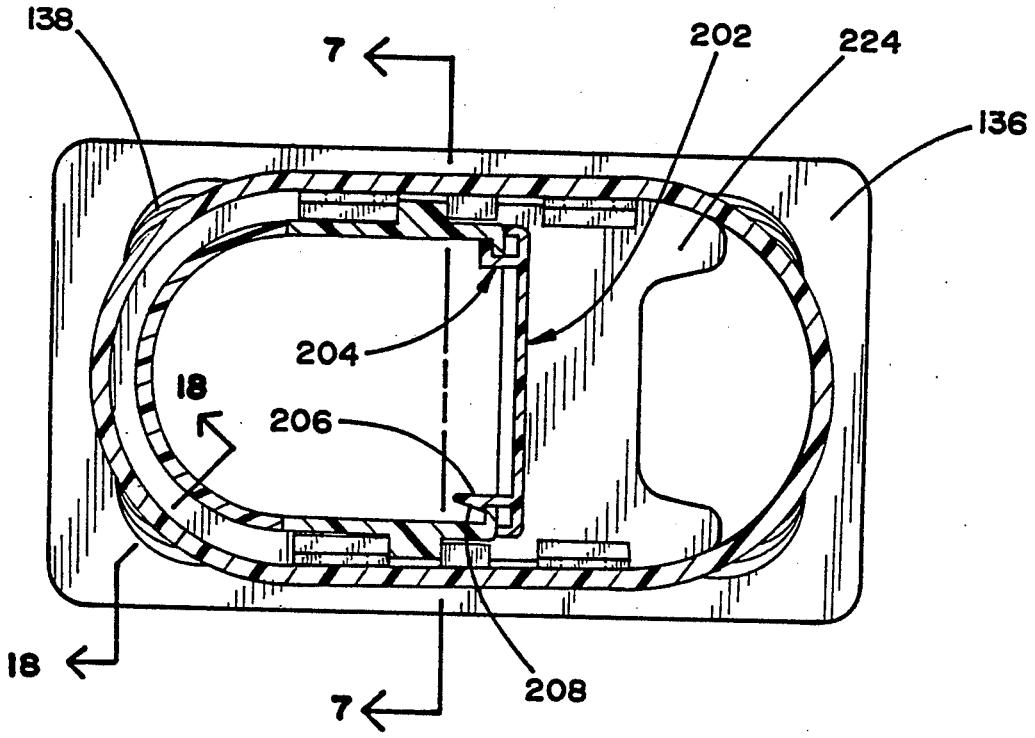
FIG. 6 is an underside view of the retractable communications terminal center shown in FIGS. 2 and 3.
Figure 7:
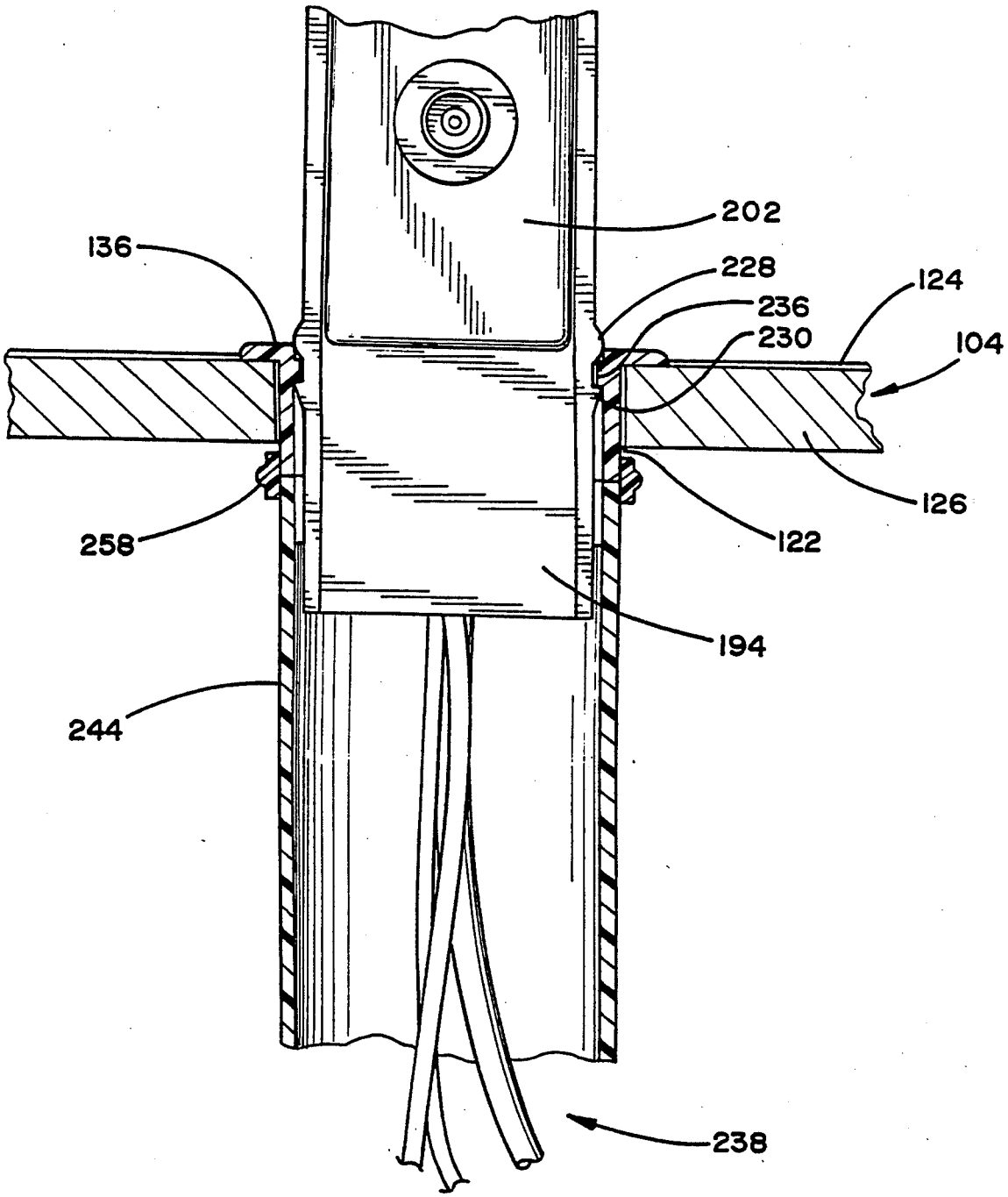
FIG. 7 is a partial sectional end view of the retractable communications terminal center shown in FIG. 6, and taken along section lines 7—7 of FIG. 6.

As primarily shown in FIGS. 4–7, the communications terminal center 100 is adapted to be mounted within an oval, rectangular or any suitably shaped slot 122 formed within a furniture component, such as the work surface 104 depicted FIG. 1 and partially depicted in FIGS. 4 and 7. The work surface 104 can, for example, be the working surface of a desk or similar furniture component. Typically, the work surface 104 may have a veneer 124 or other conventional protective and aesthetically desirable surface secured to the top of the work surface 104. The main body 126 of the work surface 104 may be constructed of wood, plastic or similar materials. The communications terminal center 100 provides a structurally sound, relatively simplistic structure and aesthetically desirable means for connecting communication lines from a conventional source located below the work surface 104 to one or more terminals nearer the top of work surface 104 and then to communications devices (such as the computer apparatus 106 or telephone 108 shown in FIG. 1).

Figure 2:
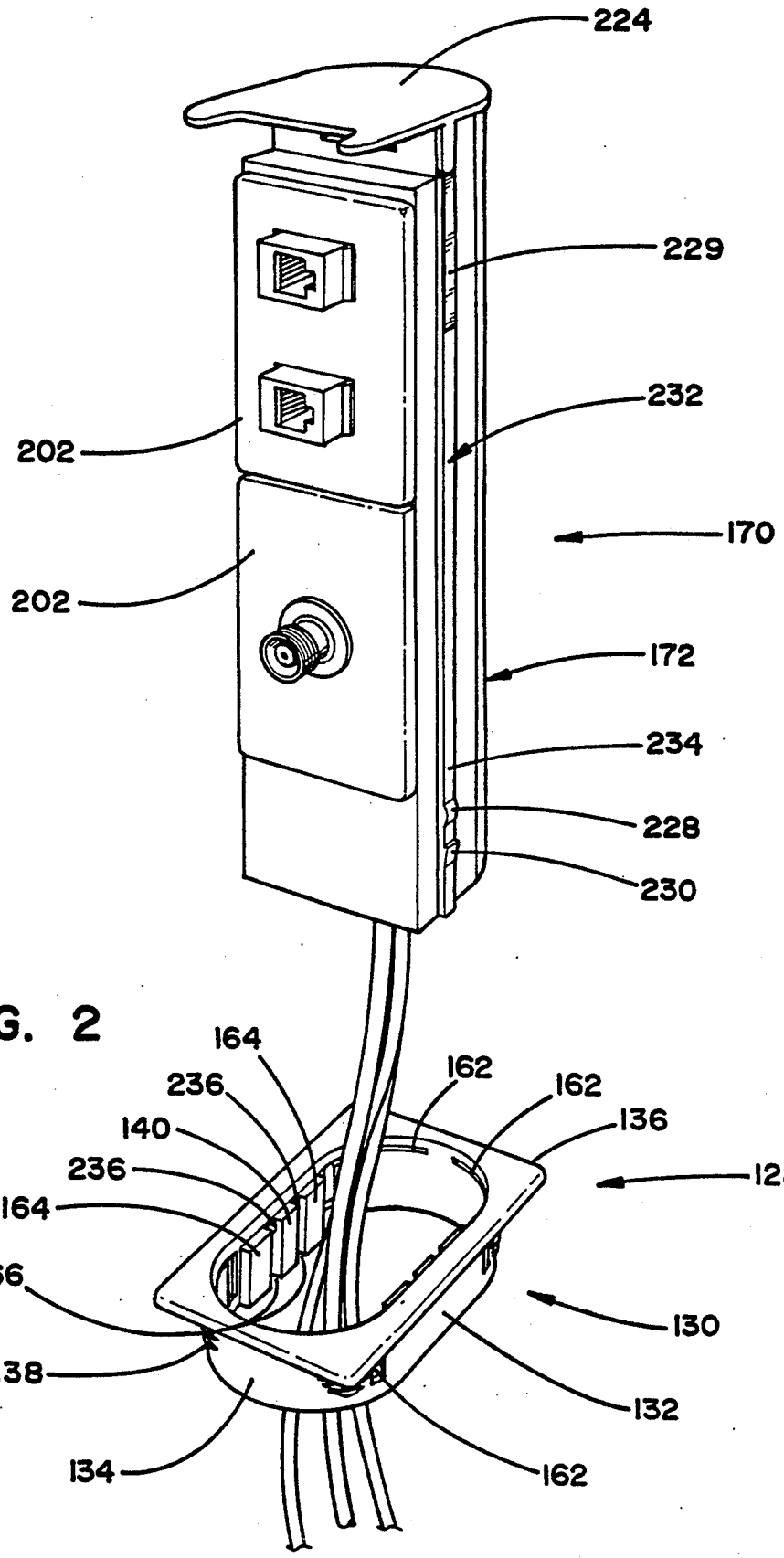
FIG. 2 is a perspective view of various components of the retractable communications terminal center in accordance with the invention as shown in FIG. 1, with the communications terminal center removed from the work surface.
Figure 3:
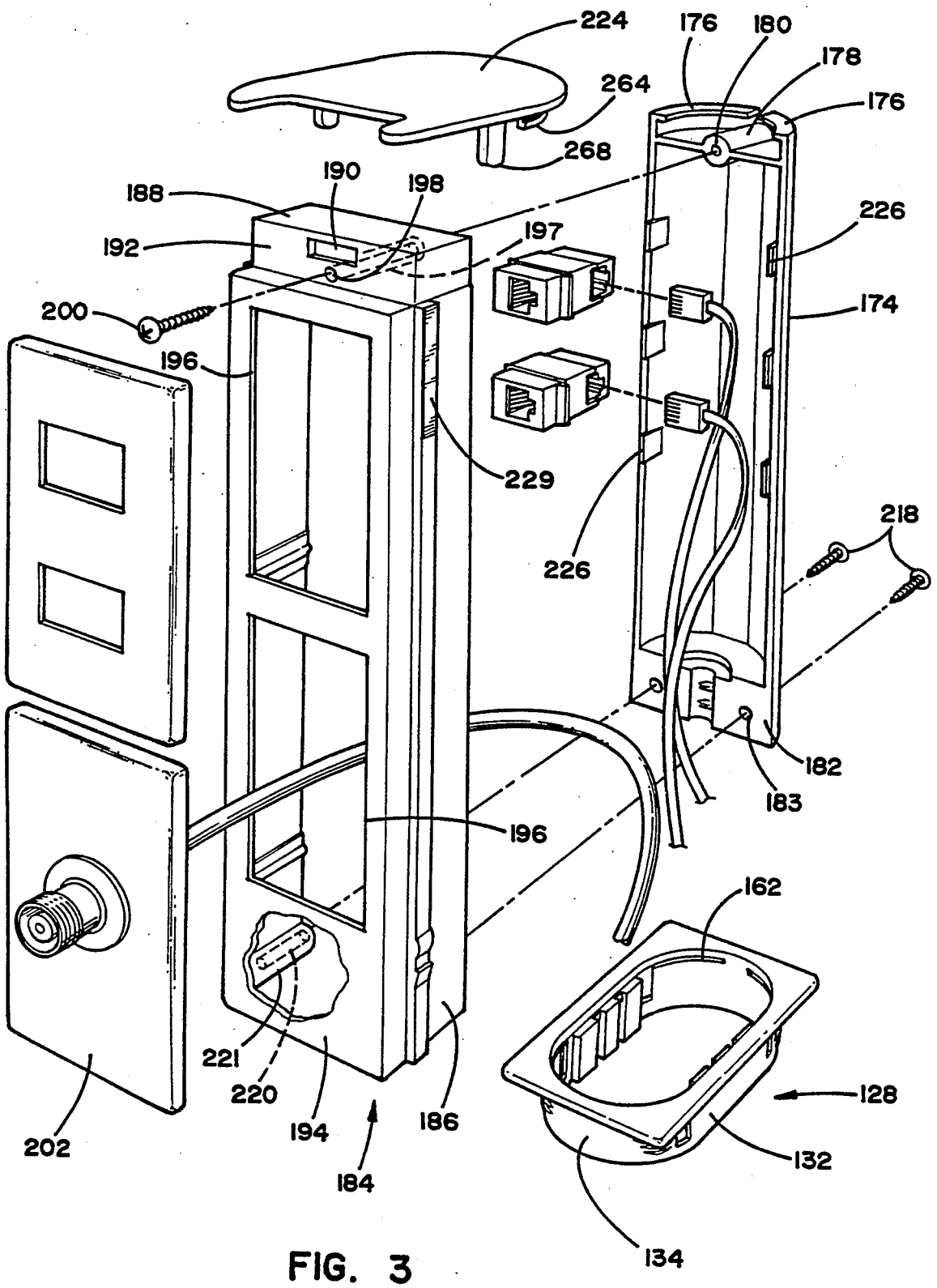
FIG. 3 is an exploded view of the retractable communications terminal center shown in FIG. 2, and further showing various individual components of the communications terminal center.

Referring primarily to FIGS. 2 and 3, but as also shown in part in various other figures of the drawings, the communications terminal center 100 can include a stationary upper housing 128. The upper housing 128 can be of any desired shape, such as the substantially oval shape shown in FIGS. 2 and 3. The stationary upper housing 128 can include a vertically disposed and oval-shaped casing 130 which can be characterized as forming a sleeve. The casing 130 can be formed by vertically disposed and opposing lateral side portions 132 integrally interconnected by means of vertically disposed and opposing end portions 134. Mounted to the upper edge or surface of the casing 130 formed by the side portions 132 and end portions 134 is a horizontally disposed collar 136. The horizontally disposed collar 136 can be interconnected with the casing 130 by means of connecting screws (not shown) or the like.

However, it is preferable if the horizontally disposed collar 136 is constructed integrally with the casing 130, as primarily shown in the sectional view of FIG. 7. The horizontally disposed collar 136 is also preferably formed in a shape substantially conforming to the shape of the casing 130.

The oval-shaped slot 122 formed in the work surface 104 and the veneer 124 is configured so as to have a length and width relatively larger than the corresponding distance between the lateral side portions 132 and the distance between the opposing end portions 134 of the upper housing 128, respectively. Conversely, the length and width corresponding to the outer perimeter of the horizontally disposed collar 136 are slightly larger than the corresponding dimensions of the slot 122. Accordingly, when the stationary upper housing 128 is mounted in the slot 122, the casing 130 is positioned below the veneer 124 on the top of the work surface 104. Correspondingly, the outer perimeter of the horizontally disposed collar 136 overhangs the slot 122 so as to be positioned above the work surface 104, with the lower surface of the collar 136 substantially flush with the veneer 124, as shown primarily in FIGS. 4 and 7. In this manner, the collar 136 provides a supporting element for the housing 128.

Figure 18:
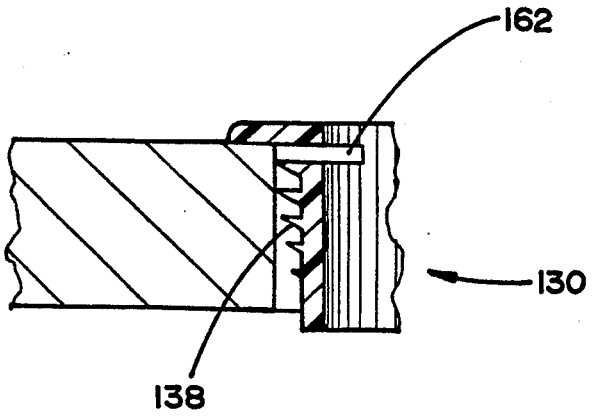
FIG. 18 is a partial view of one corner of a stationary upper housing of the communications terminal center, as secured to a work surface.
Figure 19:
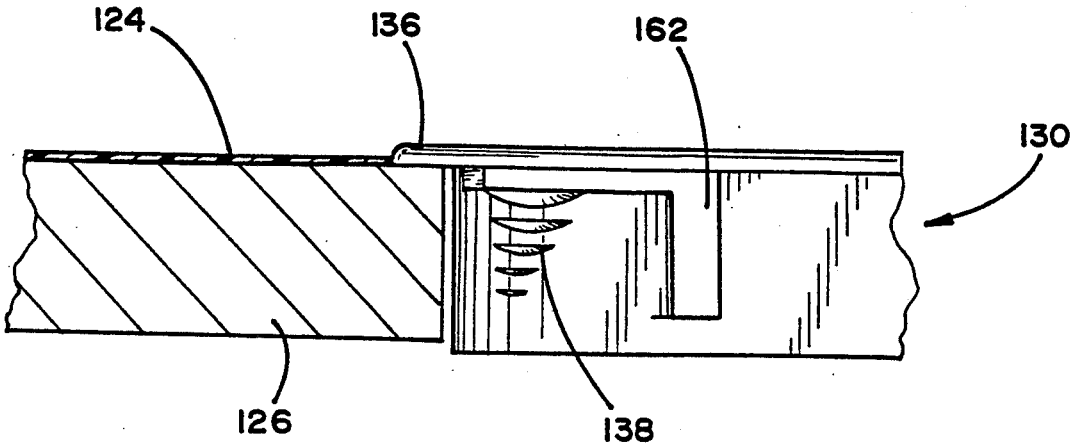
FIG. 19 is an end view of the corner section shown in FIG. 18, showing how the section can be connected to the work surface.

To secure the stationary upper housing 128 to the work surface 104, the outer surface of the casing 130 can include a series of graduated lips 138 positioned on the corners of the casing 130. When the main body 126 of the work surface 104 is constructed of wood or of similar materials, the housing 128 can be secured to the work surface 104 by manually forcing the housing 128 downwardly through the slot 122. The graduated lips 138, with the proper dimensions of the slot 122 relative to the dimensions of the casing 130, will form a gripping interconnection with the main body 126 of the work surface 104. This gripping interconnection is primarily shown in FIG. 18. With this arrangement, the graduation of the lips 138 prevents the upper housing 128 from being moved upwardly relative to the work surface 104. Correspondingly, the overhanging configuration of the horizontally disposed collar 136, relative to the dimensions of the slot 122, prevents the housing 128 from being moved downwardly through the slot 122.

It should be emphasized, however, that other means can be employed to secure the housing 128 to the work surface 104. For example, a clamping arrangement as generally described in the commonly owned U.S. Pat. No. 4,747,788 issued May 31, 1988 can also be employed. Other types of securing arrangements for securing the housing 128 to the work surface 104 can be utilized without departing from the primary novel concepts of the invention.

Figure 15:
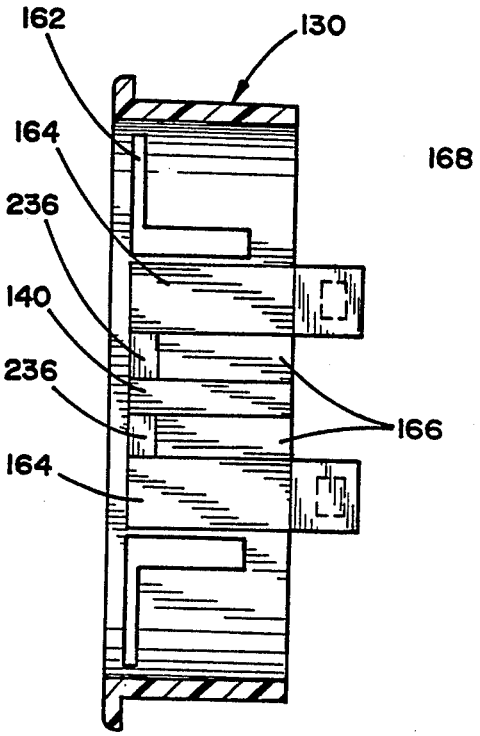
FIG. 15 is a sectional view of the upper housing shown in FIG. 14, and taken along section lines 15—15 of FIG. 14.

Turning to FIGS. 2, 3 and 15, the stationary upper housing 128 can also include a series of L-shaped upper slots 162 at the corners of the side portions 132 and end portions 134, with each of the slots 162 positioned adjacent a corresponding set of the graduated lips 138. The slots 162 assist in providing a flexibility or resiliency to the casing 130, so as to facilitate mounting of the casing 130 to the work surface 104, and to facilitate movement of the carriage 170 through the casing 130 as described in subsequent paragraphs herein.

Further, as shown primarily in FIGS. 2, 3, 5, 6 and 14 the stationary upper housing 128 includes a pair of centrally located, inwardly-directed opposing central ribs 140 mounted in a vertical disposition at substantially the midpoints on the inside surface of the lateral side portions 132. The central ribs 140 extend the vertical height of the casing 130, and can be connected to or otherwise integrally formed with the interior surface of the lateral side portions 132. Adjacent each side of the opposing central ribs 140 is a second inwardly-directed opposing outer rib 164. Each of the opposing outer ribs 164 can be connected to or otherwise integrally formed with the interior surface of the corresponding one of the lateral side portions 132. Like the central ribs 140, the opposing outer ribs 164 can also extend the vertical height of the casing 130. As shown primarily in FIGS. 5 and 6, the centrally located opposing flanges 140 and the second opposing flanges 164 form a pair of inwardly-directed grooves or channels 166 on each side 132 of the casing 130. The grooves or channels 166 are vertically oriented and extend from the bottom edges of the casing 130 to a position substantially flush with the bottom surface of the horizontally disposed collar 136 at the top of the casing 130. The purposes of the grooves or channels 166 will be described in subsequent paragraphs herein.

Figure 8:
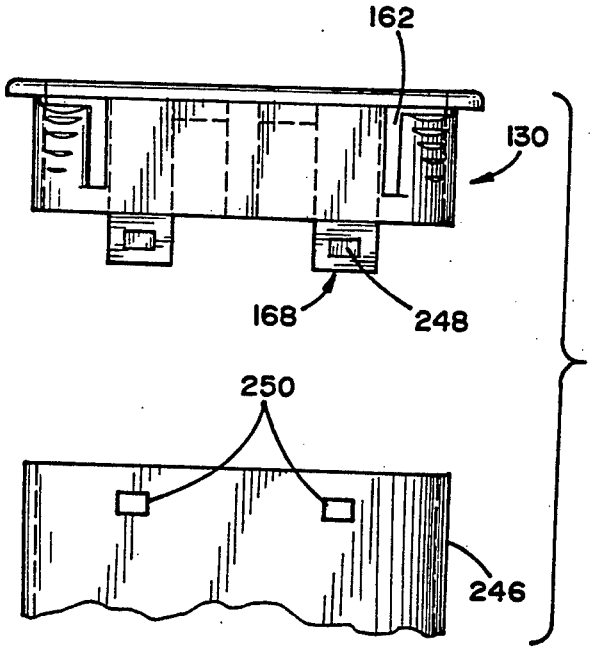
FIG. 8 is a side view of a stationary upper housing which can be utilized with the embodiment of the retractable communications terminal center shown in FIG. 2, with means for interconnecting the lower extrusion cover to the housing.
Figure 9:
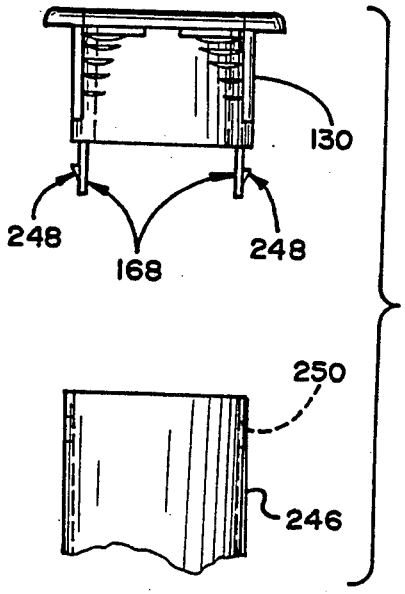
FIG. 9 is an end view of the stationary upper housing of the retractable communications terminal center as shown in FIG. 8.

Still further, as shown primarily in FIGS. 8 and 9, the stationary upper housing 128 can also include a pair of tabs 168 extending downwardly from the lower surface or edge of each of the lateral side portions 132 of the casing 130. The tabs 168 can be connected to or otherwise preferably integrally formed with the side portions 132 of casing 130. The purposes and function of the tabs 168 will also be described in subsequent paragraphs herein.

Turning again primarily to FIGS. 2 and 3, the communications terminal center 100 in accordance with the invention further includes a manually-operable and retractable carriage 170 having a normally closed or retracted position as shown by numerical reference 116 in FIG. 1 and as also shown in the solid line format of FIG. 4. Referring to FIG. 2, the carriage 170 can comprise an elongated terminal box 172. As shown in FIG. 3, the terminal box 172 can be formed by a channeled member 174 having an elongated and vertically disposed configuration. The channeled member 174 is substantially U-shaped in horizontal cross section and forms an arcuate and preferably integrally formed chamber. The channeled member 174 includes a post 178 extending inwardly toward the interior of the channeled member 174 from an interior surface thereof near the upper end of the channeled member 174. The post 178 includes a threaded hole 180 extending axially therethrough. The channeled member 174 also includes a lower base portion 182, having threaded or non-threaded holes 183 extending therethrough for purposes of interconnecting other elements to the channel member 174 as subsequently described herein. The top edge of the channel member 174 can be provided with an inwardly directed lip 176 engaging the cover plate 224 as subsequently described herein.

As further shown in FIG. 3, the carriage 170 also includes a face plate 184 having opposing side portions 186 interconnected at their upper edges by a top portion 188. The face plate 184 also includes a front panel 194. The front panel 194 includes a series of appropriately sized apertures 196 which are utilized, as subsequently described herein, for purposes of receiving communications terminal modules 202. The face plate 184 can also include a recessed portion 192 having a well 190 for mounting the cover plate 224 as subsequently described herein.

The front panel 194 can include a post 197 extending inwardly therefrom, with a hole 198 extending therethrough. The front panel 194 can also include a pair of lower posts 221 extending inwardly therefrom, having holes 220 extending therethrough, as shown in the cut away portion of FIG. 3. The lower posts 221 are located near the bottom of the front panel 194 and can be integrally formed into the side portions 186 of the face plate 184. When the face plate 184 is appropriately aligned with the channeled member 174, the hole 198 will be in alignment with the post 178 and threaded hole 180, and the posts 221 and the threaded holes 220 will be in alignment with the holes 183. Accordingly, the face plate 184 can be rigidly secured to the channeled member 174 by means such as a connecting screw 200 received through the hole 198 and threadably engaging the posts 178 through the threaded holes 180, and additional screws 218 received through holes 183 and threadably engaging the lower posts 221 through the threaded holes 220.

Prior to mounting the face plate 184 to the channeled member 174, a series of communications terminal modules 202 can be mounted within the terminal box 172 in any suitable and conventional manner. One method of mounting could include an L-shaped tab 204 and a snap tab 206 having a wedge shaped lip 208, both mounted on the rear surface of the communications module 202, and adapted to engage the front panel 194, as shown if FIG. 6. Suitable communications modules 202 can include AMP FLEX-MODE TM interconnect modules or PANDUIT PAN-NET TM snap-in, modular face plates. Connectors installed in the communications modules 202 can include, among others, RJ-11, RJ-45 BNC TNC twin-ax, universal data connectors, Thinnet Tap, RS 232, IBM Type 1 and 2, fiber optics jacks or any other suitable data connector.

Still further, and as also shown in FIG. 3, the channeled member 174 can include a series of outwardly extending tabs 226 located on each leg of the U-shaped configuration of member 174 and vertically aligned therealong. The tabs 226 can be utilized as a further means of interconnecting and aligning the channeled member 174 with the face plate 184. More specifically, the face plate 184 can include a series of slots (not shown) extending rearwardly from the opposing side portions 186 and positioned so as to be in alignment with the tabs 226 when the face plate 184 is properly secured to the channeled member 174.

As further shown in FIG. 3, the face plate 184 of the terminal box 172 can include a pair of bosses 228 extending laterally outward from the opposing side portions 186 of the face plate 184. The bosses 228 are positioned slightly below the lowermost aperture 196 which receives one of the communication terminals 202. As further shown in FIG. 3, a pair of ledges 230 can also be formed in the opposing side portions 186 of the face plate 184, and are preferably positioned slightly below the laterally extending bosses 228.

In addition, the communications terminal center 100 can include a pair of elongated ledges 229 formed on the opposing side portions 186 at the upper portion of the face plate 184. The ledges 229 are shown in FIG. 3 and provide a slight frictional engagement with the housing 128 so as to prevent the carriage 170 from "free falling" when moving from an extended position to a lowered position. Also, the frictional engagement prevents the carriage 170 from "bouncing" or otherwise freely moving when the carriage is in the retracted position, absent external lifting forces on the carriage 170.

With the carriage 170 being constructed with components as previously described herein and illustrated in FIG. 3, the carriage 170 and, in particular, the terminal box 172 will have the structure shown in FIG. 2. With this structure the terminal box 172 can be characterized as comprising vertically disposed lateral side portions 232 formed by the opposing side portions 186 of the face plate 184 and the legs of the U-shaped channeled member 174.

Figure 5:
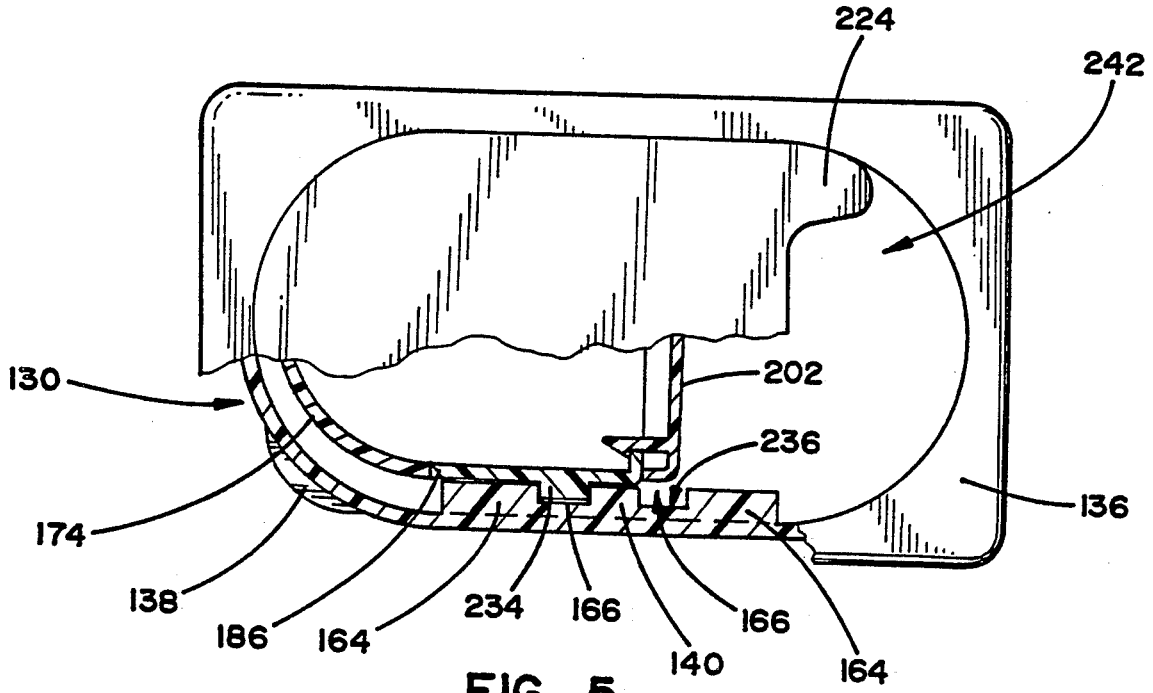
FIG. 5 is a plan view of the retractable communications terminal center shown in FIGS. 2 and 3, with the cover plate partially cut away.

As primarily shown in FIGS. 5 and 6, the face plate 184 of the terminal box 172 includes a pair of guide ribs 234 located near the front edges of each of the side portions 186. The guide ribs 234 are appropriately sized so as to fit within one of the grooves 166 formed by the central rib 140 and one of the side ribs 164 associated with the casing 130. The previously described bosses 228 and ledges 230 are preferably formed along the surfaces of the guide ribs 234.

Still further, and as also shown in FIG. 3, the carriage 170 can include an upper cover plate 224 which is horizontally disposed and sized so as to fit essentially flush with the horizontally disposed collar 136 of the housing 128 when the terminal box 172 is in a lower, retracted position. The cover plate 224 can be secured to the upper portion of the channeled member 174 and face plate 184 in any suitable and conventional manner.

Preferably, the cover plate 224 can snap onto the terminal box 172. As shown primarily in FIGS. 16 and 17, the cover plate 224 can have an L-shaped tab 262 projecting downwardly from the center of the underside of the cover plate 224, and adapted for engaging the well 190 in the recessed portion 192 of the front panel 194. Additional engagement points with the terminal box can be provided by snaps 264 extending downwardly from the underside of the cover plate 224 near its rounded end. Each snap 264 have an arcuate shape adapted to mate with the channel member 174, and a wedge shaped lip 266 adapted to engage the lip 176 on the channel member 174. Guiding tabs 268 can be provided on the cover plate 224, which extend downwardly from the underside of the cover plate 224 at the outside edges, and which engage the opposing side portions 186 of the face plate 184. Preferably, the guiding tabs 268 are sized and located so that when the cover plate is in place on the terminal box 172, the guiding tabs extend the guiding surface defined by the guide ribs 234 up to the top of the terminal box 172.

The cover plate may thus be affixed to the terminal box 172 by placing the L-shaped tab 262 into the well 190 into the recessed portion 192 of the front panel 194 and then pushing downwardly on the cover plate 224 over the snaps 264, forcing the wedge shaped lips 266 past the channel member lips 176. The L-shaped tab 262, and the wedge shaped lips 266 thus restrain the cover plate 224 against separating forces and keep the cover plate 224 and terminal box 172 securely fastened together. The tab 262 and snaps 264 are preferably constructed with sufficient resiliency so that a sufficiently large force may disengage the wedge shaped lips 266 from the channel member lips 176 without causing damage to part.

To assemble the communications terminal center 100 as described herein, the various components of the carriage 170 and terminal box 172 can be assembled as previously described with respect to FIG. 3. Correspondingly, the stationary housing 128 can be appropriately positioned and secured within the slot 122 of the work surface 104. The carriage 170 can then be inserted into the stationary upper housing 128 in either of two opposing directions.

More specifically, the carriage 170 can be inserted into the housing 128 in a manner so that the guide ribs 234 of the face plate 184 are received within one set of opposing grooves or channels 166 on the interior surface of the casing 130. With the guide ribs 234 positioned in one set of opposing channels 166 as shown in FIGS. 5 and 6, the communication terminals 202 would face toward the right side of the illustrations shown in FIGS. 5 and 6. Conversely, the carriage 170 can be reversed in direction and the guide ribs 234 can be inserted into the other pair of opposing channels or grooves 166. In this opposing configuration, the communication terminals 202 would face toward the left side of the views illustrated in FIGS. 5 and 6.

Preferably, the bosses 228 are integrally formed on the guide ribs 234 of the opposing side portions 186 of face plate 184. In addition, the bosses 228 should be sized and at least slightly resilient or otherwise configured so that they can be "forced" through the casing 130, when a slight amount of force is manually exerted downwardly on the carriage 170.

As primarily shown in FIG. 7, although each groove or channel 166 is formed intermediate the central rib 140 and one of the side ribs 164, a horizontal ledge or lip 236 is located at the upper portion of the groove or channel 166 but positioned slightly below the horizontally disposed collar 136. Preferably, the ledge or lip 236 can be integrally formed with the corresponding central rib 140 and corresponding adjacent side ribs 164. The lip 236 can be of various sizes, but preferably has a vertical dimension equal to or less than the distance between one of the bosses 228 and a corresponding ledge 230 on a guide rib 234. As described in subsequent paragraphs herein, as the carriage 170 is moved upwardly, the ledges 230 will abut the undersides of the lips 236 within the grooves 166, thereby preventing any further upward movement. However, with the ledges 230 having the particular wedge-shaped configuration as shown primarily in FIGS. 2, 3 and 7 and with the side portions 232 of the carriage 170 being slightly resilient, the ledges 230 can be forced downwardly past the lips 236 of the grooves 166, during installation of the carriage 170 into the stationary housing 128.

The operation of the communications terminal center 100 will now be described with respect to FIGS. 1–7. With the communications terminal center 100 in a closed and retracted position as shown in solid line format in FIG. 4, the upper cover plate 224 of the carriage 170 is essentially flush with the housing collar 136. The carriage 170 is maintained in the closed position by means of gravity, i.e., merely the weight of the carriage 170. However, if desired, it is also possible to include an additional thickness in the guide ribs 234 at the upper portions thereof so that there is some frictional engagement between the guide ribs 234 and the surfaces of the grooves 166 when the carriage 170 is in the closed position.

Figure 16:
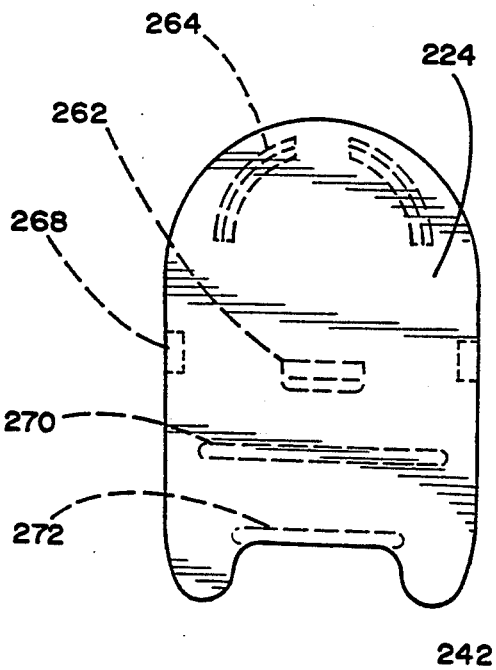
FIG. 16 is a plan view of the upper cover plate which can be employed with the retractable communications terminal center shown in FIG. 2.
Figure 17:
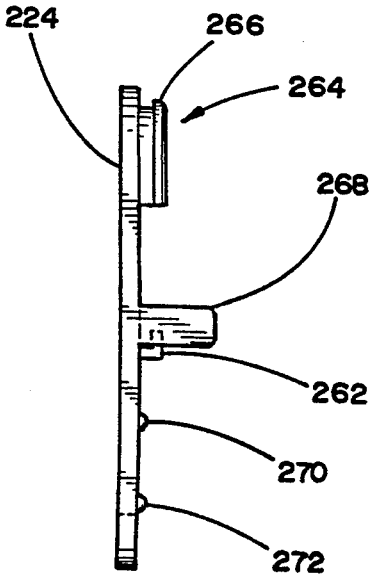
FIG. 17 is an elevation view of the cover plate as shown in FIG. 16.

When the user desires to extend the communications terminal center 100 upwardly by extending the carriage 170 out of the stationary housing 128 into an open position, the user can position his/her fingers below the portion of the cover plate 224 which extends to the right side of FIGS. 5 and 6. The underside of the cover plate 224 can be provided with ribs 270 and 272, as shown in FIGS. 16 and 17, for additional gripping surface. The user can then manually pull the carriage 170 upwardly relative to the housing 128. The bosses 228 are also of a size and a sufficient resiliency so that manually-exerted forces can readily force the bosses 228 past the lips 236 and thereabove. As the carriage 170 is moved upwardly a sufficient distance, the lowermost edges of the lips 236 will abut the ledges 230. The ledges 230 and lips 236 are of appropriate relative sizes so as to completely prevent any further upward movement of the terminal box 172. If the user then releases the forces exerted on the carriage 170, the terminal box 172 will extend downwardly only a relatively small distance to the extent that the bosses 228 abut the inner periphery of the horizontally disposed collar 136. The actual distance between the bosses 228 and the ledges 230 can be of any desired length, but should be appropriately sized so that when manual forces are released from the terminal box 172, the box 172 is located in an upward-extended position with each of the communication terminals 202 readily accessible to the user.

With the bosses 228 supported on the lips 236 of the upper housing 128, the carriage 170 is in the opened position as shown in dotted line format in FIG. 4 and in FIG. 7. In this position, the communication terminals 202 will be located above the upper surface of the work surface 104 and the horizontal plane of the veneer 124. It is apparent that the actual position of the terminals 202 relative to the plane or upper surface of the work surface 104 will be dependent on the initial positioning of the terminals 202 in the terminal box 172, and the positioning of the bosses 228.

With the terminals 202 positioned above the work surface 104 and external to the slot 122, the user can then readily access any of the terminals 202 to plug in desired communications device cords. When the communications devices have been connected, the user can then press downwardly on the upper cover plate 224 with a force sufficient so as to "squeeze" the bosses 228 past the lips 236. Accordingly, the carriage 170 will then move downwardly. The weight of the terminal box 172 will essentially cause the carriage 170 to move relatively freely in a downward direction.

As the carriage 170 is moved downwardly, the communication lines 238 will tend to position themselves in a manner so as to extend through an opening 242 (FIGS. 5 and 6) formed between the edge of the cover plate 224 and the interior edge of the horizontally disposed collar 136. In accordance with the foregoing, the communication lines 238 are connected to the device with the connections substantially hidden from view. In this manner, the communications terminal center 100 in accordance with the invention advantageously provides an aesthetically desirable communications terminal center, with the further advantage that the communications terminal center 100 includes communication terminals 202 which can be extended upwardly from the work surface 104 so as to be made readily accessible to the user, and yet still remain usable even when the carriage 170 is in a closed, retracted position.

Still further, the communications terminal center 100 is advantageous in that it does not incorporate any elements such as spring assemblies or similar mechanisms for purposes of carriage movement. In addition, the user can readily move the carriage 170 upwardly or downwardly relative to the housing 128 without the necessity of using special tools, rotating screws, or undertaking any similar actions. The user must only exert forces upwardly or downwardly to move the carriage 170 in the desired direction.

It should also be mentioned that the grooves 166 formed by the ribs 140 and 164 of the casing 130 also serve to provide in part a guide for the terminal box 172. That is, the grooves 166 provide channels in which the terminal box 172 can move in an upward or downward direction. The grooves 166 thus provide a means to maintain the vertical alignment of the terminal box 172 relative to the housing 128. Furthermore, the casing 130 essentially comprises a symmetrical structure whereby two mirror half-portions can be formed by taking a vertical section through the middle of the casing 130. Accordingly, as previously described, the terminal box 172 can be located on either side of the central flanges 140.

Other advantages of the communications terminal center 100 in accordance with the invention can be achieved with the addition of various other components to the communications terminal center 100. For example, as shown in FIGS. 4 and 7, an extended and elongated cover tube 244 can be incorporated within the communications terminal center 100. More specifically, the cover tube 244 can be in the form of an elongated structure constructed by various means, such as extrusion processes. The cover tube 244 can be essentially hollow and interconnected by various means at the top portion thereof to the tabs 168 previously described and shown in FIGS. 8 and 9.

For example, the cover tube 244 can comprise a hollow sleeve 246 having a shape substantially conforming to the shape of the casing 130 of the upper housing 128. At the upper portion of the sleeve 246, the sleeve 246 can be connected to the tabs 168 by means of connecting screws, rivets or the like (not shown). The lower end of the sleeve 246 can be completely open, or, alternatively, can include a partial lower cover (not shown). In either event, the communication lines can be extended through the lower opening of the sleeve 246. The addition of the extended cover tube 244 provides a means for achieving additional guidance of the communication lines to an appropriate connection. In addition, the extended cover tube 244 also provides additional storage area for communication lines 238 in a manner so that they will not interfere with a user having his/her legs extending below the work surface 104 or otherwise become entangled with other apparatus or structures located below the work surface 104.

As previously described, the extended cover tube 244 can be interconnected with the upper housing 128 by means of connecting screws, rivets or the like directly connected to the tabs 168 shown in FIGS. 8 and 9. Alternatively, however, other arrangements can be utilized for interconnecting the extended cover tube 244 to the stationary housing 128. For example, as shown in FIGS. 8 and 9, the tabs 168 of the upper housing 128 can each include a ledge or lip 248 extending laterally outwardly from the corresponding tab 168. Each of the ledges or lips 248 can have a substantially wedge-shaped configuration, with the lower portions thereof having a beveled structure. Correspondingly, the sleeve 246 of the extended cover tube 244 can include slots 250 located so as to be in alignment with the tabs 168. To interconnect the cover tube 244 to the upper housing 128, the sleeve 246 can be positioned below the housing 128 and then extended upwardly toward the tabs 168. The tabs 168 can be of a sufficient flexibility and resiliency so that they will be "squeezed" inwardly as the sleeve 246 contacts the ledges or lip 248. As the upper edges of the slots 250 in the sleeve 246 extend above the upper surface of the ledges or lips 248, the tabs 168 can then again flex outwardly. As the tabs 168 flex outwardly, the sleeve 246 is supported on the ledges or lips 248. Again, it should be emphasized that the tabs 168 should have a sufficient resiliency so as to allow an inward flexure during this movement. Also, the beveled configuration of the lower portions of the ledges or lips 248 assists in this movement.

Figure 10:
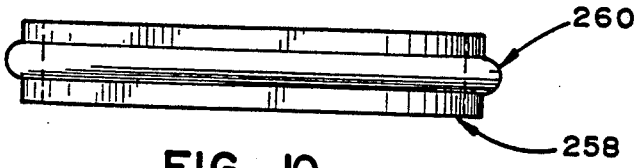
FIG. 10 is an elevation view of the sleeve for covering the joint between the stationary upper housing and the lower extrusion cover.

As an alternative configuration, and as shown in FIG. 10, the tabs 168 can be replaced with a horizontally disposed and elongated flange 252. This flange 252 can also have a corresponding elongated ledge or lip 254 extending lengthwise on the outer surface of the flange 252. A corresponding elongated slot 256 can be positioned on opposing sides of the sleeve 246 of the cover tube 244. Again, as the sleeve 246 is moved upwardly toward the flange 252, the flange will sufficiently flex so as to allow the upper edge of the slot 256 to move above the upper edge of the ledge 254. After such movement, the flange 254 will again flex outwardly and the extended cover tube 244 will essentially be locked in position on the stationary upper housing 128. It will be apparent to those skilled in the art that other arrangements for interconnecting the extended cover tube 244 to the stationary housing 128 can be utilized.

Figure 11:
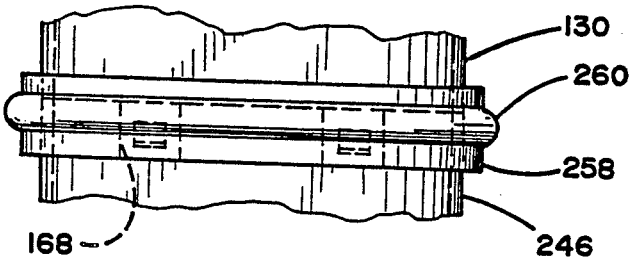
FIG. 11 is an elevation view of the sleeve of FIG. 10, shown installed on the interconnecting means of FIG. 8.
Figure 13:
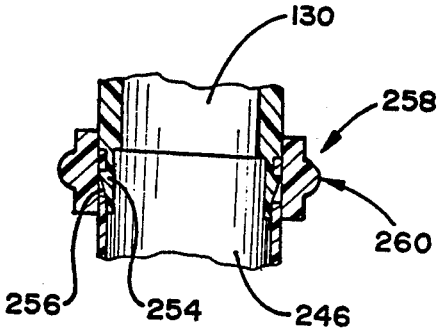
FIG. 13 is an end view in cross section of the interconnection arrangement of FIG. 12 with the sleeve of FIG. 10 installed.
Figure 12:
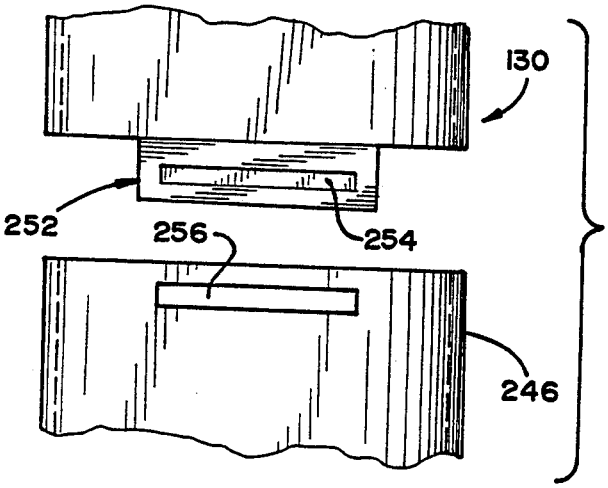
FIG. 12 is an elevation and partially exploded view of an upper housing which can be employed with the retractable communications terminal center shown in FIG. 2, and further partially showing the lower extrusion tube and an alternate interconnection arrangement therebetween.
Figure 14:
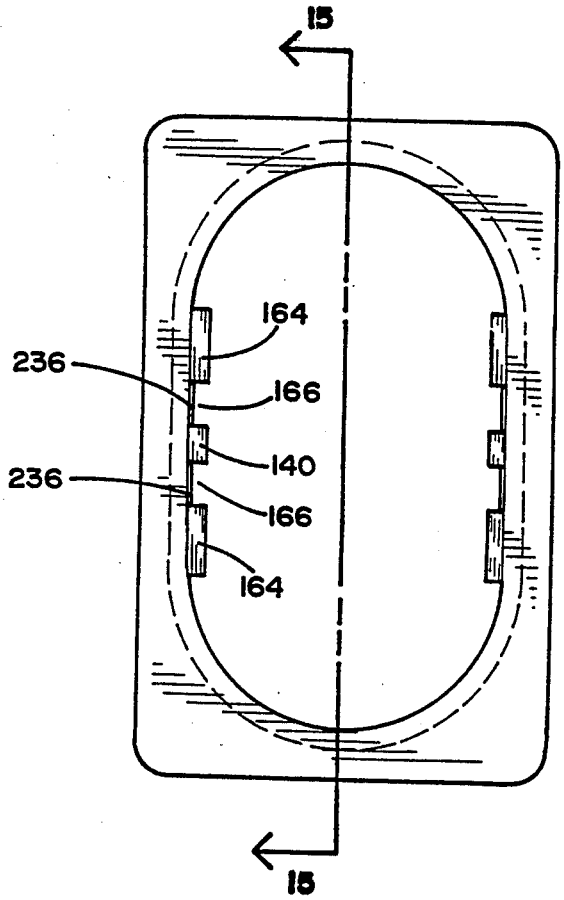
FIG. 14 is a plan view of the upper housing which can be employed with the retractable communications terminal center shown in FIG. 2.

Additionally as shown in FIGS. 10, 11 and 13 sleeve 258 can have an internal opening of a shape to slidably engage the exterior of tube 246 and be moved upwardly around tube 246 until it compressively engages lips or ledges 248 of tabs 168 or lips or ledges 254 of flange 252. In this position the ring 258 having an internal opening of slightly less than the height of lips or leges 248 or 254 is forcibly in engagement with the lips or ledges 248 or 254 and retains the tube 246 in a locked position so as not to allow disengagement of tube 246 from tabs 168 or flanges 252.

Additionally, sleeve 258 as shown in FIG. 13 can have an outer annular ring 260 extending entirely around the circumference of sleeve 258 and centered in the width of the sleeve which adds inwardly compressive forces to sleeve 258 which further induces compressive forces to retain sleeve 258 in its position over tube 246 and lips or ledges 248 of tabs 168 or lips or ledges 254 of flange 252.

Still further, it will be apparent to those skilled in the pertinent arts that other embodiments of communications terminal centers in accordance with the invention can be designed. For example, the communications terminal center 100 can include a second separate cover plate (not shown in the drawings) which can be utilized to at least partially enclose the opening 242 formed in the stationary upper housing 128 when the carriage 170 is in a closed, retracted position. However, even with such a second cover plate, it is preferable in accordance with the invention to configure the cover plate so as to still allow an opening for communications lines between the cover plate 224 of the carriage 170 and the second cover plate.

Still further, although optional with respect to the principal concepts of communications terminal centers in accordance with the invention, the communications terminal center 100 can also include a set of flexible brushes (not shown) or the like which can extend outwardly from the cover plate 224 and extend over the opening 242. The brushes can be secured to the cover plate in any suitable manner, such as by means of a notch or similar arrangement in the cover plate, in which one end of the brushes could be secured. The brushes could provide protection from foreign objects accidentally falling into or being inserted within the cord opening 242.

Figure 20:
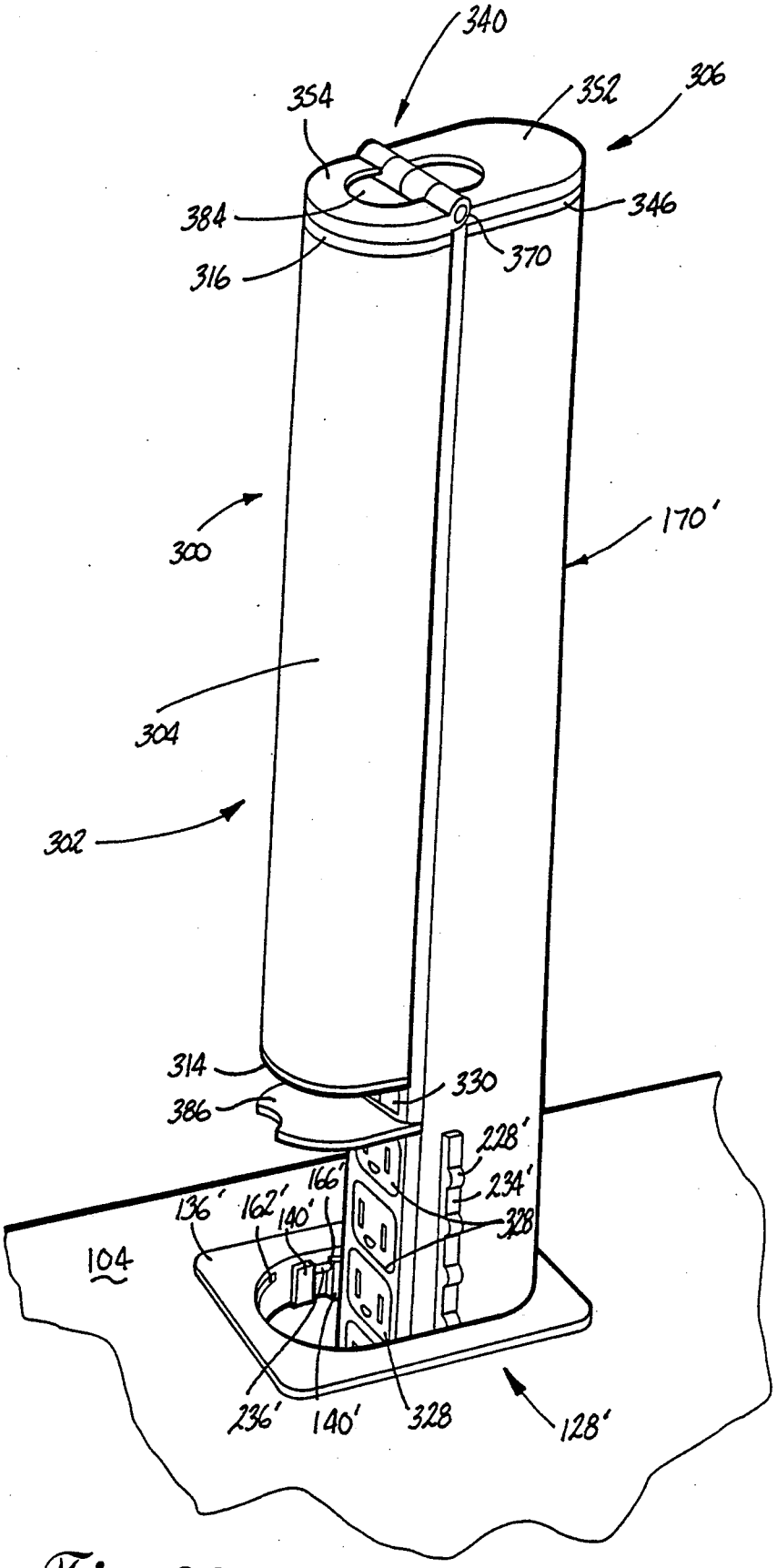
FIG. 20 is a perspective view of an alternative embodiment of a terminal center according to the invention, the terminal center incorporating a fold-out lighting fixture shown in a vertical orientation.

FIG. 20 illustrates an alternative embodiment of a terminal center 300 according to the invention. The terminal center 300 is similar in many respects to the communications terminal center 100 of the previous embodiment. Accordingly, like parts are numbered with primed like reference numerals. However, in the terminal center 300, the carriage 170' is elongated compared to the carriage 170 of the communications terminal center 100 and incorporates a "folding" lighting fixture 302 for providing illumination upon the work surface 104.

Figure 21:
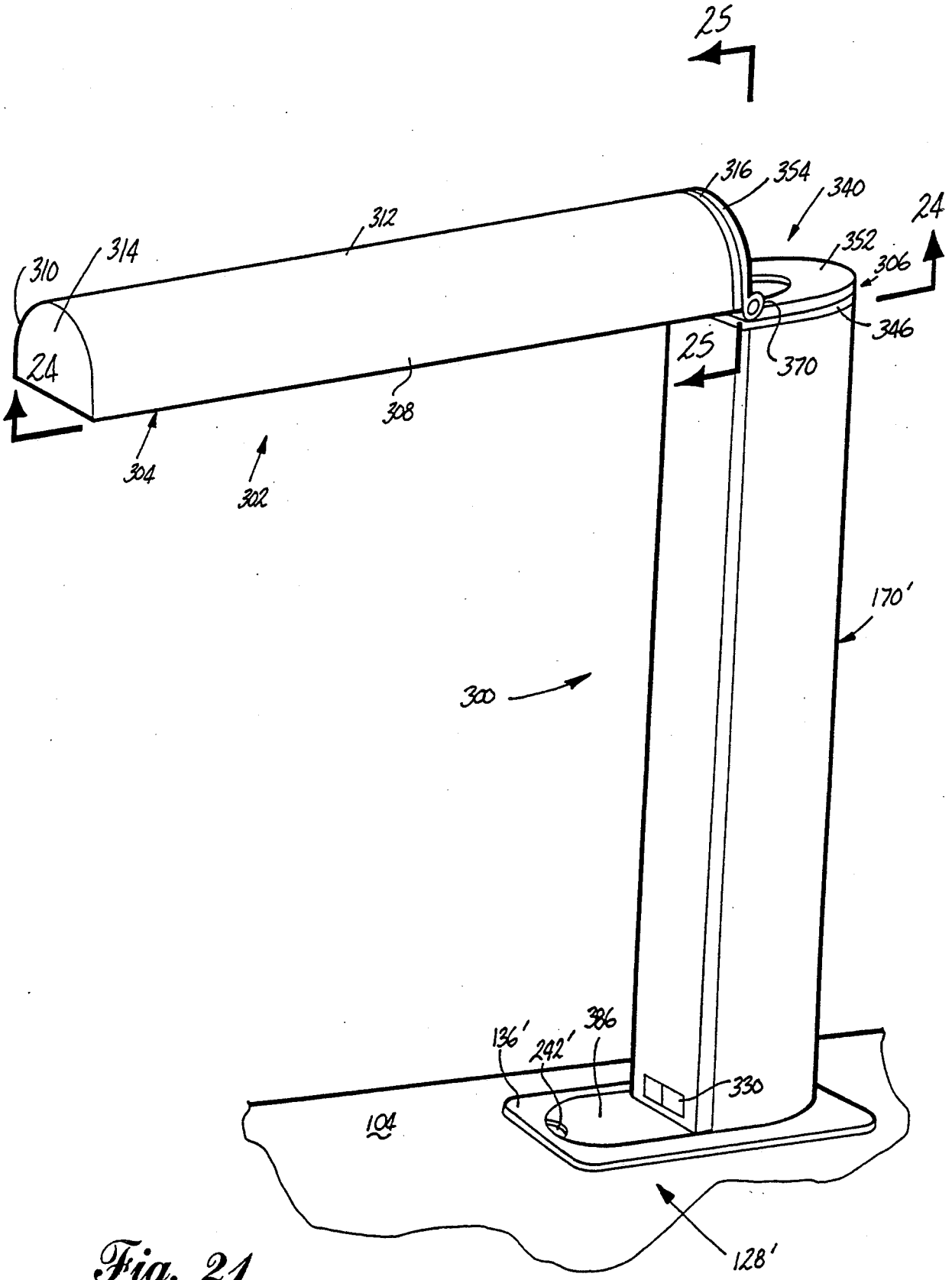
FIG. 21 is a perspective view of the terminal center of FIG. 21, with the lighting fixture shown in a horizontal orientation.

The lighting fixture 302 comprises an elongated housing 304 having a complimentary shape to the carriage 170' and which pivotably mounts to an upper end 306 of the carriage 170'. The housing 304 pivots from a vertical orientation adjacent the carriage 170' (FIG. 20) to a horizontal orientation cantilevered outwardly away from, and normal to, the carriage 170' (FIG. 21). An elongated rectangular front panel 308, a substantially parallel elongated rectangular rear panel 310, and an arcuate upper panel 312 connecting the front and rear panels 308, 310 form the housing 304. Preferably, the housing front, rear and upper panels 308, 310 and 312, respectively are integrally formed in an injection molding process. The housing 304 also comprises an outside end panel 314, away from the carriage 170', and inside end panel 316, adjacent the carriage 170', with each end panel 314 and 316 having a shape complimentary to the arcuate cross section of the housing 304.

Figure 22:
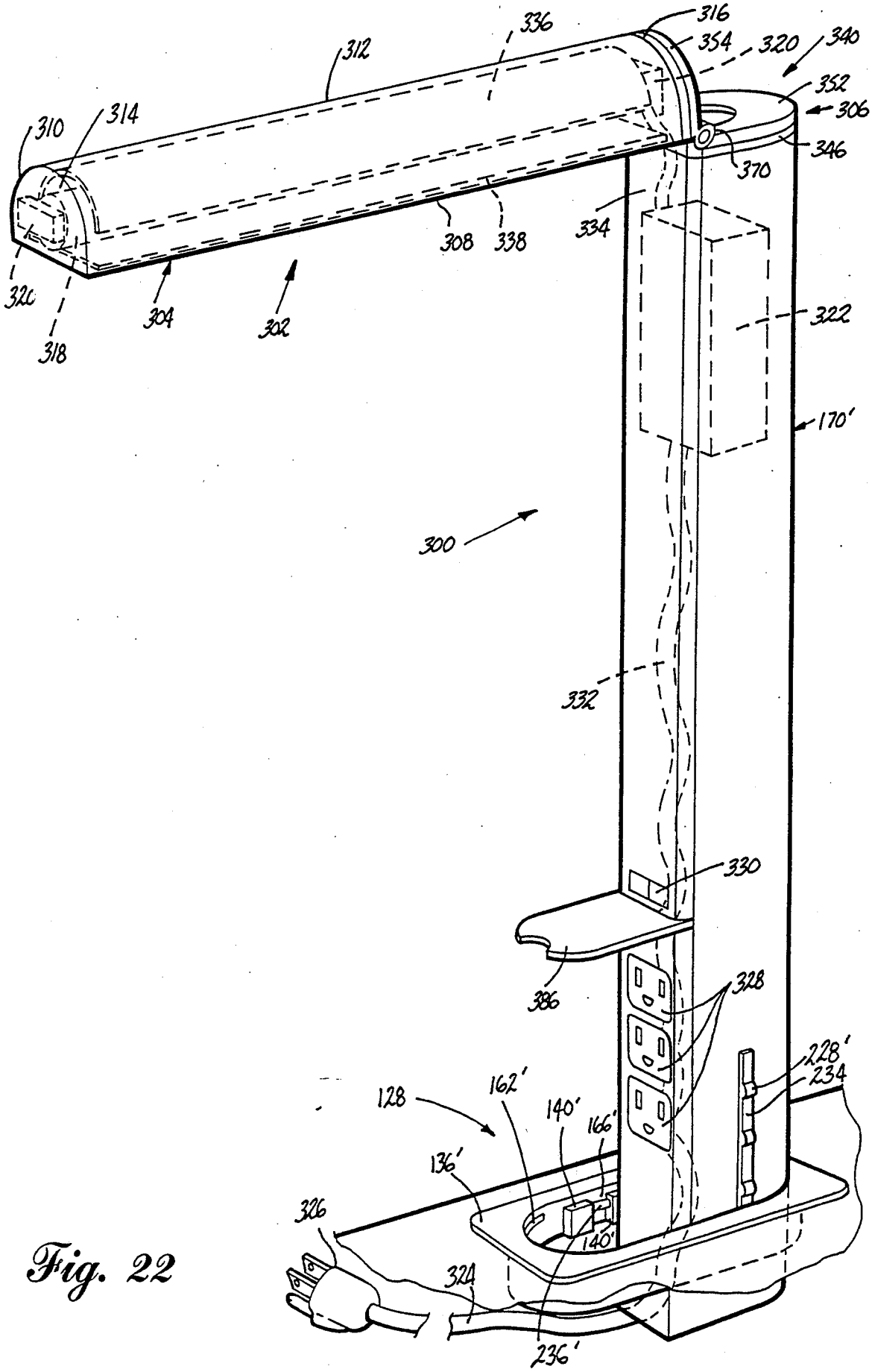
FIG. 22 is a perspective view of the terminal center of FIG. 20, with the internal wiring and electrical components shown in phantom.

Turning to FIG. 22, a bulb 318 mounts within the housing 304 by means of commonly known sockets 320 affixed to the outer and inner end panels 314 and 316. A fluorescent type bulb 318 is illustrated. However, any commonly known type of light bulb, such as incandescent or halogen, could substitute for the illustrated bulb 318, with obvious modification to the sockets and electrical connections therefor. Also, multiple bulbs 318 of any type may be provided. A ballast unit 322 mounts within the carriage 170', adjacent the lighting fixture 302.

A standard two or three conductor power cable 324, having a standard two or three prong plug 326 adapted to plug into a standard floor or wall mounted electrical power receptacle (not shown), extends out of the bottom of the carriage 170' and provides power to the terminal center 300. Of course, in many applications, the furniture in which the terminal center 300 is mounted contains electrical power distribution wiring. The power cable 324 may then be hard wired directly into the furniture's electrical distribution system (not shown).

If as shown in FIG. 22, the terminal center 300 is provided with electrical power receptacles 328, the power cable 324 connects in parallel to the receptacles 328 and provides power thereto. The power cable 324 also connects to a two position electrical switch 330. A second power cable 332 connects the switch 330 to the ballast unit 322, whereby the switch 330 controls application of electrical power to the ballast unit 322. A third power cable 334 connects the output of the ballast unit 322 to the bulb terminals 320 in a standard fashion, providing electrical power to the bulb 318. Details of the wire path between the ballast unit 322 and the lighting fixture 302 will be more fully explained hereinafter with respect to FIG. 23.

For efficient illumination from the lighting fixture 302, a reflector 336 within the housing 304 above the bulb 318 and a lens 338 (see also FIG. 24) below the bulb 318 direct its illumination into an even and pleasing pattern upon the work surface 104. The reflector 336 may be any type commonly known. However, it is preferably white or silver and arcuate in cross section. The lens 338 may be designed to focus the bulb 318 illumination into particular patterns or to simply diffuse the illumination. Reflectors and lenses for lighting fixtures are well known in the art.

Figure 23:
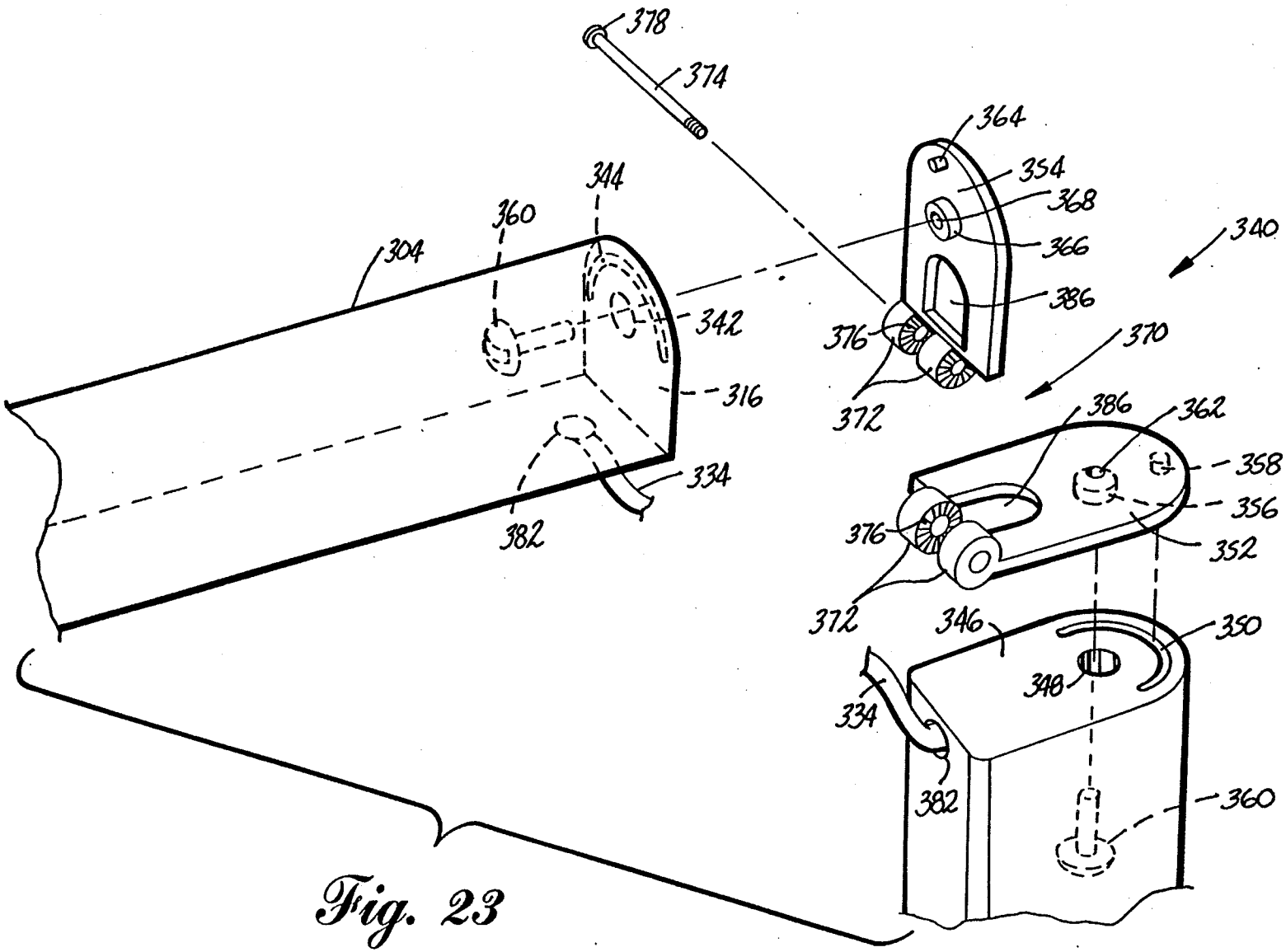
FIG. 23 is a perspective exploded view of a hinge connector connecting portions of the terminal center of FIG. 20.

FIG. 23 illustrates a hinge connector 340 which connects the lighting fixture 302 to the carriage 170', and which provides additional rotational freedom for the lighting fixture 302. The housing inner end panel 316 has a central aperture 342 and an arcuate slot 344 therethrough. An upper end panel 346 of the carriage 170' also comprises a central aperture 348 and an arcuate slot 350 therethrough. The arcuate slots 344 and 350 have a radius of curvature having an origin at the respective central aperture 342 and 348.

Figure 24:
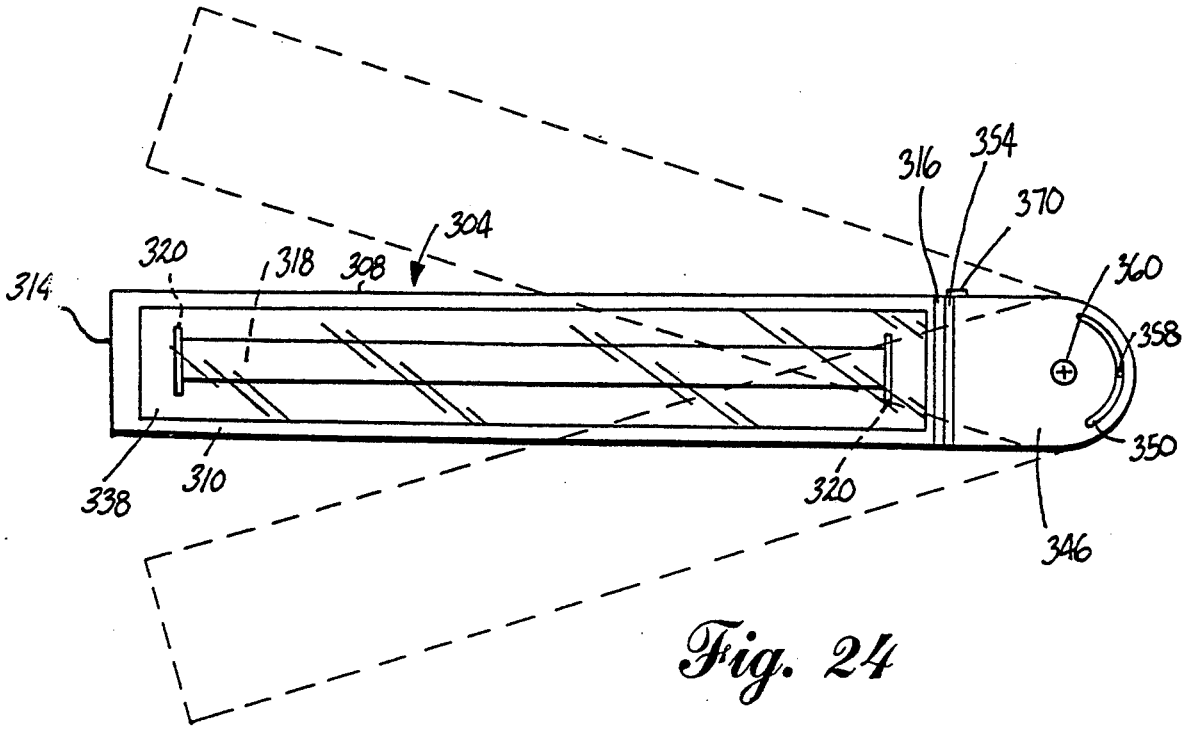
FIG. 24 is a sectional view taken along lines 24—24 of FIG. 21, and illustrating the lighting fixture's ability to pivot about a vertical axis.

The hinge connector 340 comprises a first plate 352 having a shape complimentary to the carriage upper end panel 346 and a second plate 354 having a shape complimentary to the housing inner end panel 316. The first plate 352 has a central stubshaft 356 extending outwardly therefrom and normal thereto. The first plate stubshaft 356 fits loosely within the carriage upper end panel central aperture 348, thereby allowing the hinge connector 340, and thus the lighting fixture 302, to rotate about the vertical axis of the first plate stubshaft 356. A pin 358 also extends outwardly from the first plate 352, normal thereto. When the first plate stubshaft 356 is received within the carriage upper end plate central aperture 348, the first plate pin 358 extends into the carriage upper end plate arcuate aperture 350, limiting the degree of rotation of the first plate relative to the carriage upper end plate. A wide head screw 360 extends through the carriage upper end plate central aperture 348 and threads into a coaxial threaded aperture 362 in the first plate stubshaft 356 to hold the first plate 352 to the carriage upper end panel 346. FIG. 24 illustrates the rotation of the housing 314 provided by the first plate stubshaft 356.

Figure 25:
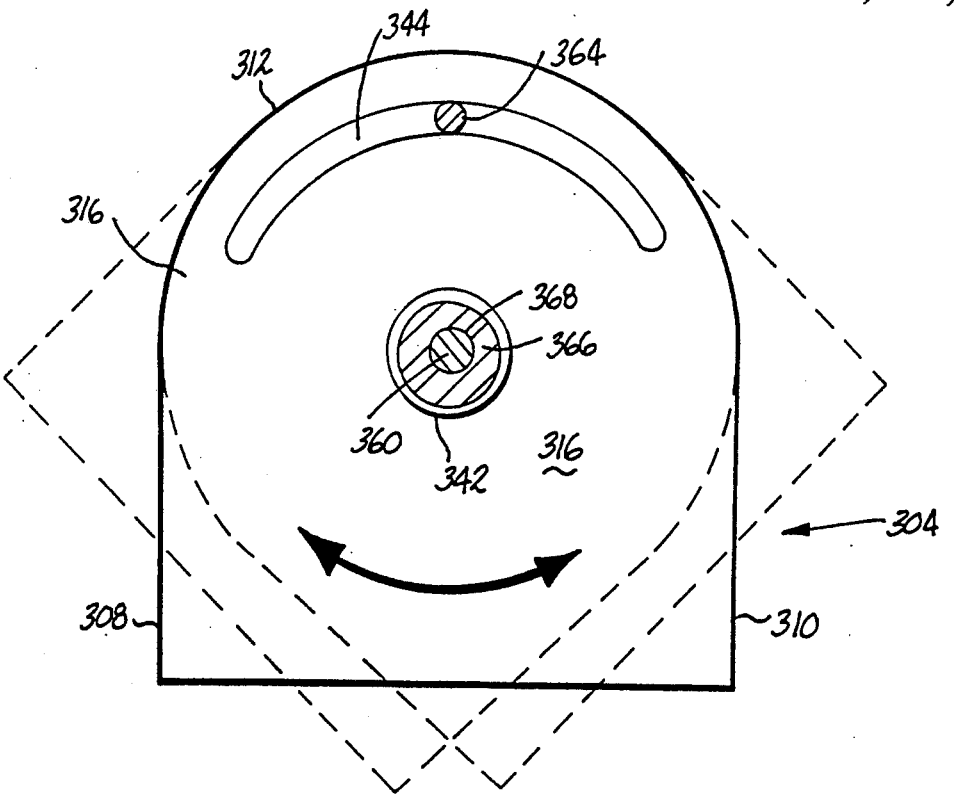
FIG. 25 is a sectional view taken along line 25—25 of FIG. 21, and illustrating the lighting fixture's ability to pivot about a horizontal axis longitudinal with the lighting fixture.

Returning to FIG. 23, the hinge connector second plate 354 has a similar construction to the first plate 352 and also has a pin 364 and a stubshaft 366 with a threaded coaxial aperture 368. The housing inner end panel 316 and the second plate 354 interconnect in the same fashion as the carriage upper end panel 346 and the first plate 352. The lighting fixture 302 can thus pivot about the horizontal axis of the second plate stubshaft 366. FIG. 25 illustrates the rotation provided by the second plate stubshaft 366. Returning to FIG. 23, the arcuate slots 344 and 350 can, of course, be of different lengths and orientations to provide the desired rotation of the lighting fixture 302 about the vertical and horizontal axes of the first plate and second plate stubshafts 356 and 366 respectively.

Figure 26:
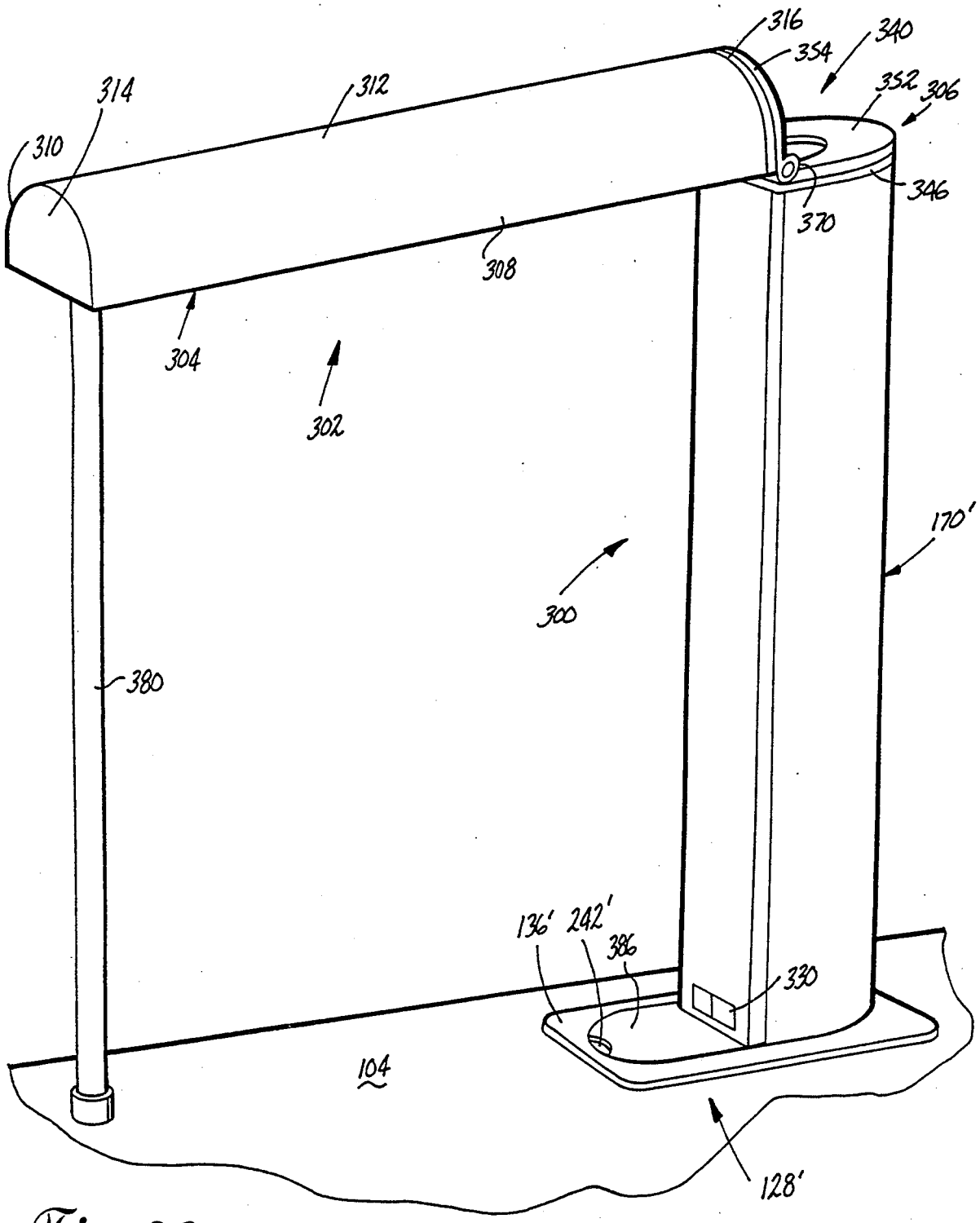
FIG. 26 is a perspective view of the terminal center of FIG. 20 illustrating an optional support leg for the lighting fixture thereof.

A high friction hinge 370 connects the hinge connector first plate 352 and second plate 354. Friction in the hinge 370 holds the lighting fixture 302 horizontally cantilevered out from the carriage 170'. The hinge 370 can comprise a series of interlaced hinge fingers 372 on each of the first and second plates 352 and 354 with a hinge pin 374 received within the fingers 372. Each of the adjacent hinge fingers 372 has detents or ridges 376 at their contact with the adjacent hinge finger 372. One end of the hinge pin 374 has a head 378 and the opposite end is threaded into either one of the hinge fingers 372 or an external nut (not shown) to compress the hinge fingers 372 together and increase the friction between them. Other high friction hinge means may substitute for the means described herein. Alternatively, or in addition to a high friction hinge 370, a fold down leg 380 may be provided, which folds down from the housing 304 adjacent the outer end panel 314 (see FIG. 26) to support the lighting fixture 302 in a horizontal orientation.

Apertures 382 adjacent the hinge 370 on each of the carriage 170' and the lighting fixture housing 314 provide for passage of the third power cable 334 out of the carriage 170' and into the housing 304. The apertures 382 may alternatively be located on the hinge connector 340. In either instance, a decorative cover (not shown) may be provided for covering the third power cable 334 where it is visible between the carriage 170' and the housing 304.

Figure 34:
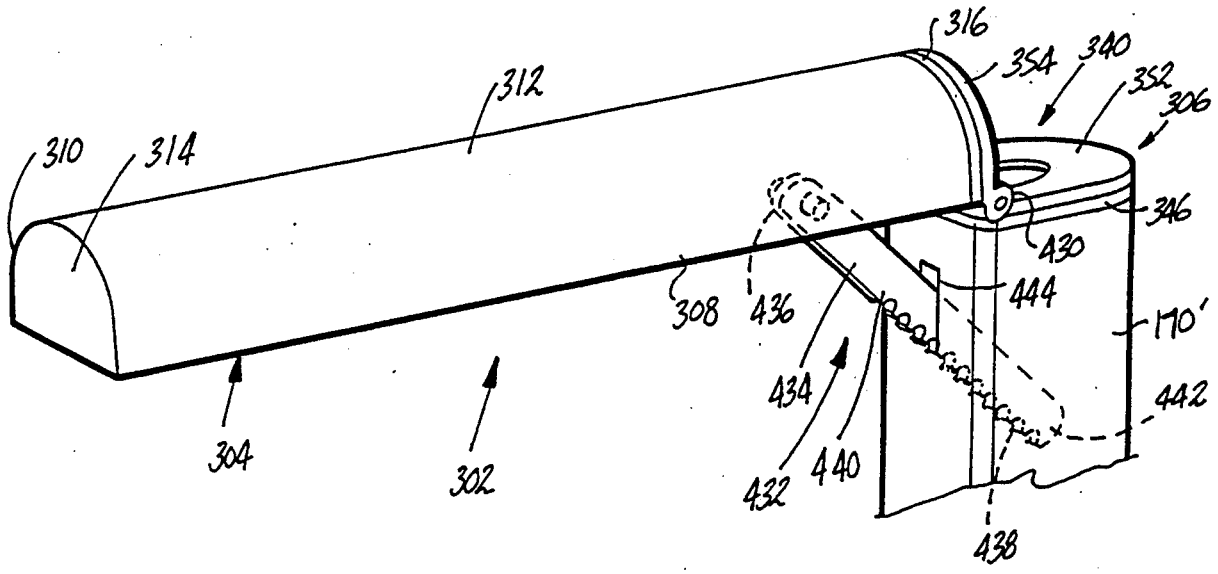
FIG. 34 illustrates a perspective view of the terminal center of FIG. 20 illustrating an option support brace for the lighting fixture thereof.

As an alternative to the high friction hinge 370 illustrated in FIG. 23, a conventional hinge 430 could be employed in connection with a support brace 432 as illustrated in FIG. 34. The conventional hinge 370 is similar in all respects to the hinge 370, with the exception that it lacks the ridges 376 and the hinge pin 374 need not compress the fingers 372 together.

The support brace 432 comprises a an elongated body 434 pivotably mounted at a first end 436 within the lighting fixture housing 304 and having a series of serrations 438 upon a lower edge 440 of a second end 442. When the lighting fixture housing 304 is in its horizontal orientation, the support brace extends from the housing 304 to the carriage 170' with the support brace body second end 442 fitting within a slot 444 on the carriage 170'. The serrations 438 engage the carriage 170' at the slot 444 and secure the lighting fixture housing 304 in the horizontal orientation. The serrations 438 allow a limited amount of adjustment of the angle of the housing 304 with respect to the carriage 170'.

Figure 27:
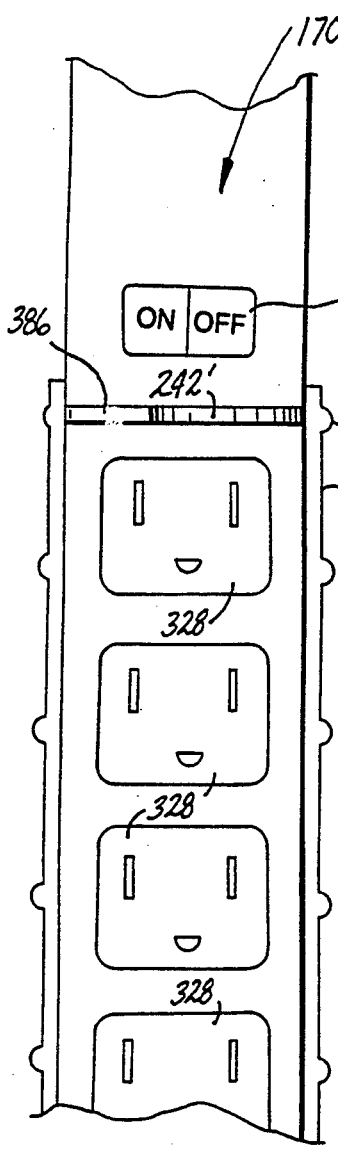
FIG. 27 is a detailed view of a portion of a carriage of the terminal center of FIG. 20, illustrating a series of terminals thereon.
Figure 29:
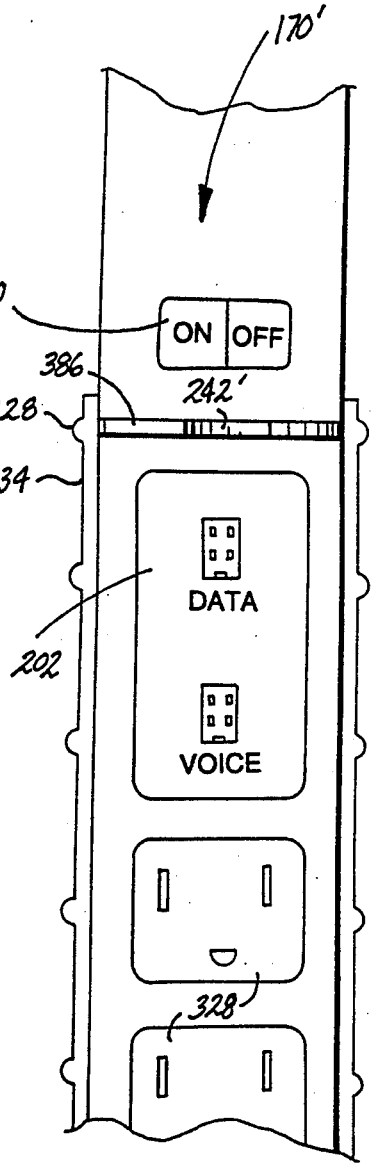
FIG. 29 is a detailed view of a portion of a carriage of the terminal center of FIG. 20, illustrating a series of terminals thereon.
Figure 28:
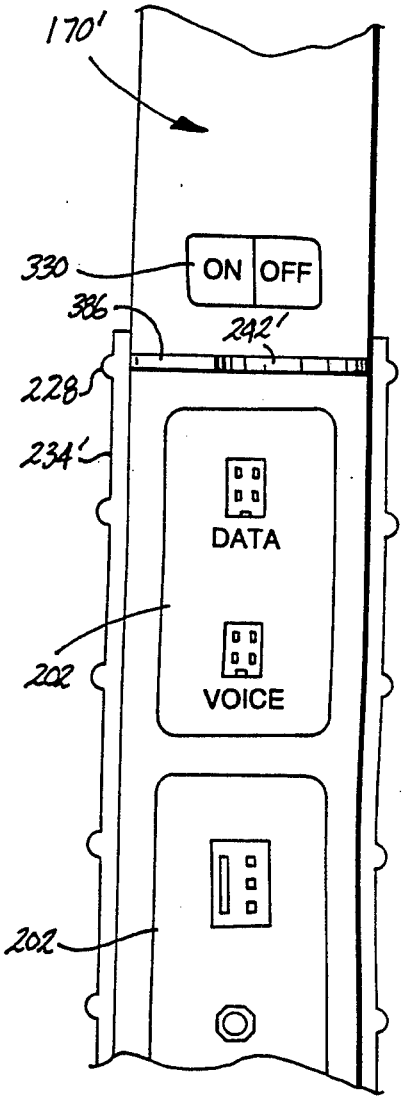
FIG. 28 is a detailed view of a portion of a carriage of the terminal center of FIG. 20, illustrating a series of terminals thereon.

FIGS. 27, 28 and 29 illustrate partially the variety of terminals which may be provided within the terminal center 300. For instance, FIG. 27 shows a terminal center 300 having all electric power receptacles 328. Four electric power receptacles 328 are shown, but the carriage 170' could be made longer or shorter to accommodate a desired quantity of terminals. FIG. 28 illustrates the terminal center 300 provided with two communications modules 202, and thus having all communications terminals. FIG. 29 illustrates that communication modules 202 and electric power receptacles 328 may be combined on the same terminal center 300. To reduce noise on the communications lines 238 (not shown in FIG. 29), the communications lines and the power cables 324, 332 and 334 (not shown in FIG. 29) can be shielded from each other with metal partition shielding (also not shown in FIG. 29).

Figure 30:
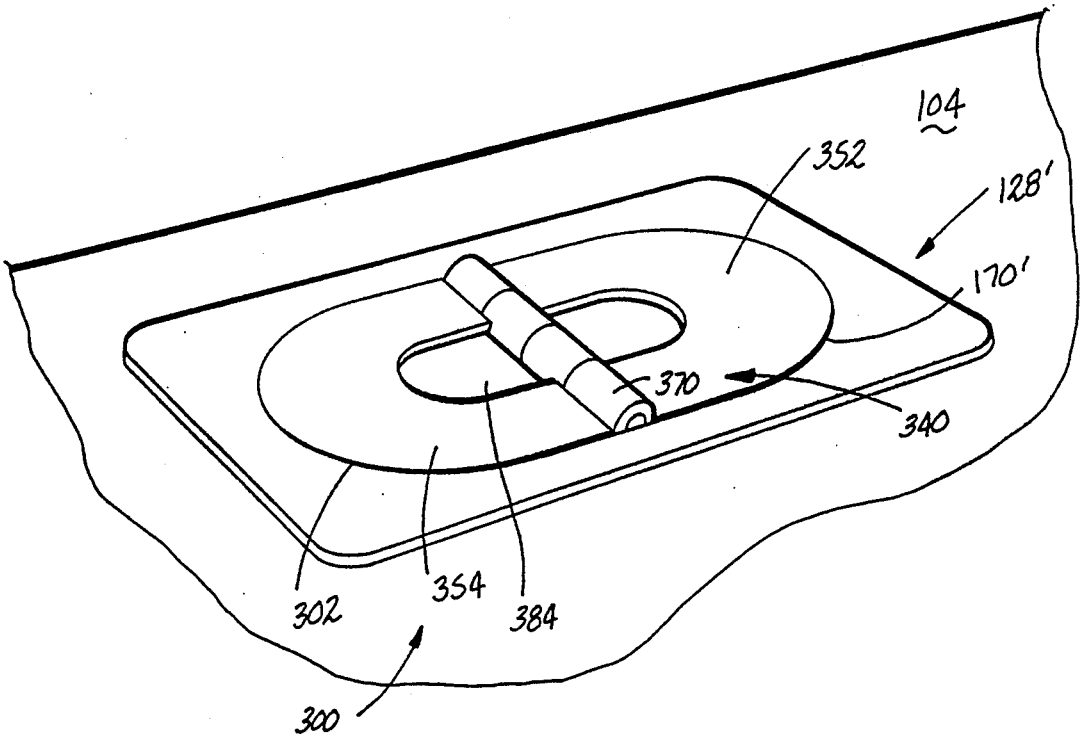
FIG. 30 is a plan perspective view of the terminal center of FIG. 20, shown with the terminal center retracted into a work surface.

FIG. 30 and FIGS. 20 and 21, illustrate operation of the terminal center 300. In FIG. 30, the terminal center 300 lies recessed into the work surface 104. Also note that FIG. 30 illustrates optional finger apertures 384 in the first and second plates 352 and 354 of the hinge connector 340, which provide increased purchase for a user's fingers as an aid in extracting the carriage 170' from the stationary upper housing 128'.

FIG. 20 illustrates the carriage 170' raised out of the stationary upper housing 128' whereby several of the electric power outlets 328 are exposed, and the lighting fixture 304 is oriented vertically and completely removed from the upper housing 128'. The upper extent of the guide ribs 234 is illustrated as terminating adjacent the uppermost terminal, which in this case is the electric power outlet 328.

FIG. 21 illustrates the lighting fixture 304 folded out into its horizontal orientation. Also, note the cover plate 386 which extends outwardly from the carriage 170' between the uppermost terminal and the light switch 330. The cover plate 386 corresponds to the upper cover plate 224 on top of the communications terminal center 100, but extends from a middle portion of the carriage 170', as this represents the position of the carriage 170' which aligns with the stationary upper housing lateral side portions 132' when the carriage 170' is in its normal operating position.

Depending upon the type of bulb or element incorporated into the lighting fixture 302, it may be desireable to provide a safety interlock (not shown) for interrupting power to the lighting fixture 302 unless it is folded out into a near horizontal orientation. Such an interlock may comprise a mercury switch in the lighting fixture housing 304 which interrupts power to the bulb 318 unless the lighting fixture 302 orientation approaches the horizontal. Alteratively, the light switch 330 can be configured so that the lighting fixture housing 304 moves the switch 330 into the off position when the lighting fixture housing 304 is folded down against the carriage 170'.

Figure 31:
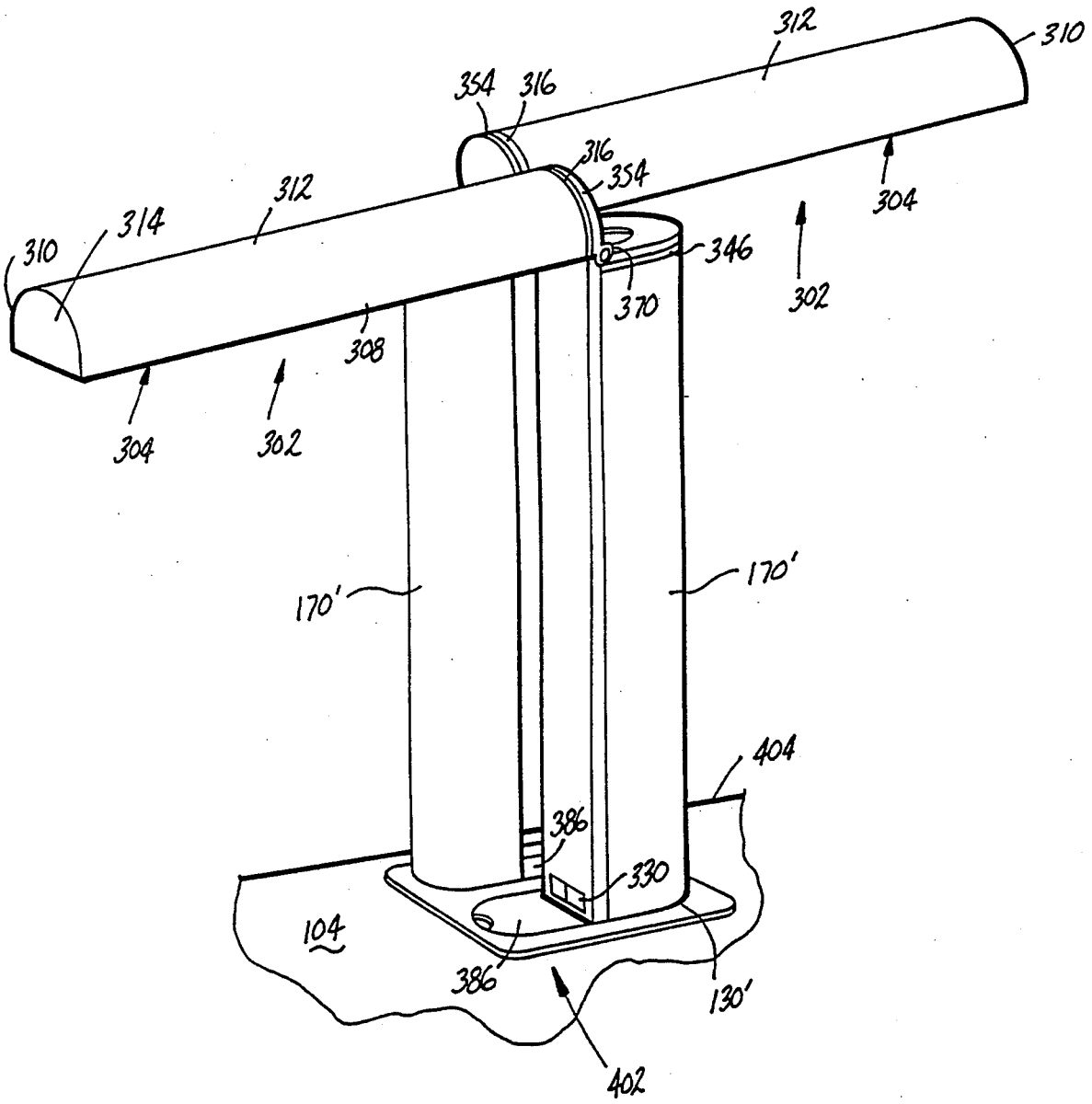
FIG. 31 illustrates a perspective view of an alternative arrangement of a terminal center according to the invention, having two carriages incorporating lighting fixtures thereon.

FIG. 31 illustrates an alternative arrangement of a terminal center 400. In this arrangement, the terminal center 400 incorporates two carriages 170', each carriage 170' carrying a lighting fixture 302. The carriages 170' and lighting fixtures 302 of the terminal center 400 are identical in all respects to the carriage and lighting fixture 170' and 302 described with respect to FIGS. 20 through 30. However, a single stationary upper housing 402 carries the two carriages 170' in side-by-side relationship. The stationary upper housing 402 is identical to the stationary upper housings 128 and 128' with the exception that it carries two casings 130'.

It is contemplated that when the terminal center 400 is incorporated into a work surface 104, the terminal center 400 would be mounted adjacent a front edge 404 of the work surface, with one carriage 170' adjacent the front edge 404 and the second carriage 170' away from the front edge 404. One of the lighting fixtures 302 would open upwards to the right, and the other lighting fixture 302 would open upwards to the left, thereby providing even illumination and a pleasing appearance.

Figure 33:
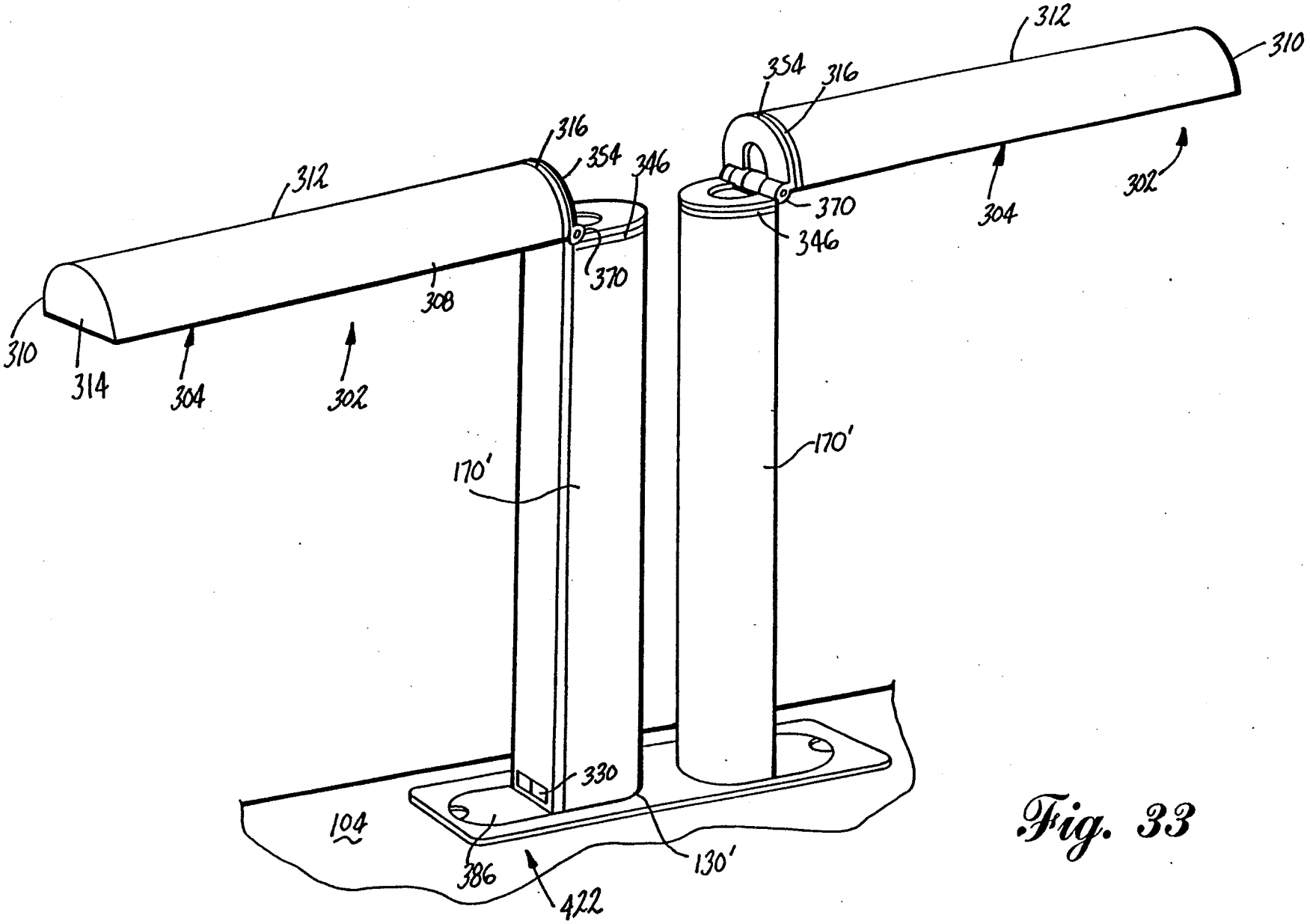
FIG. 33 illustrates a perspective view of an alternative arrangement of a terminal center according to the invention, having two carriages incorporating lighting fixtures thereon.

Of course, the two carriages 170' could also be arranged in an end-to-end relationship as illustrated in FIG. 33, with the two lighting fixtures 302 continuing to open away from each other. An alternative stationary upper housing 422 accommodates two casings 130' for carrying the carriages 170' as in the stationary upper housing 402. However, the casings 130' are arranged in an end-to-end relationship. When installed in the work surface 104, the carriages 170' have a side-by-side relationship with respect to the front edge 404 of the work surface.

Figure 32:
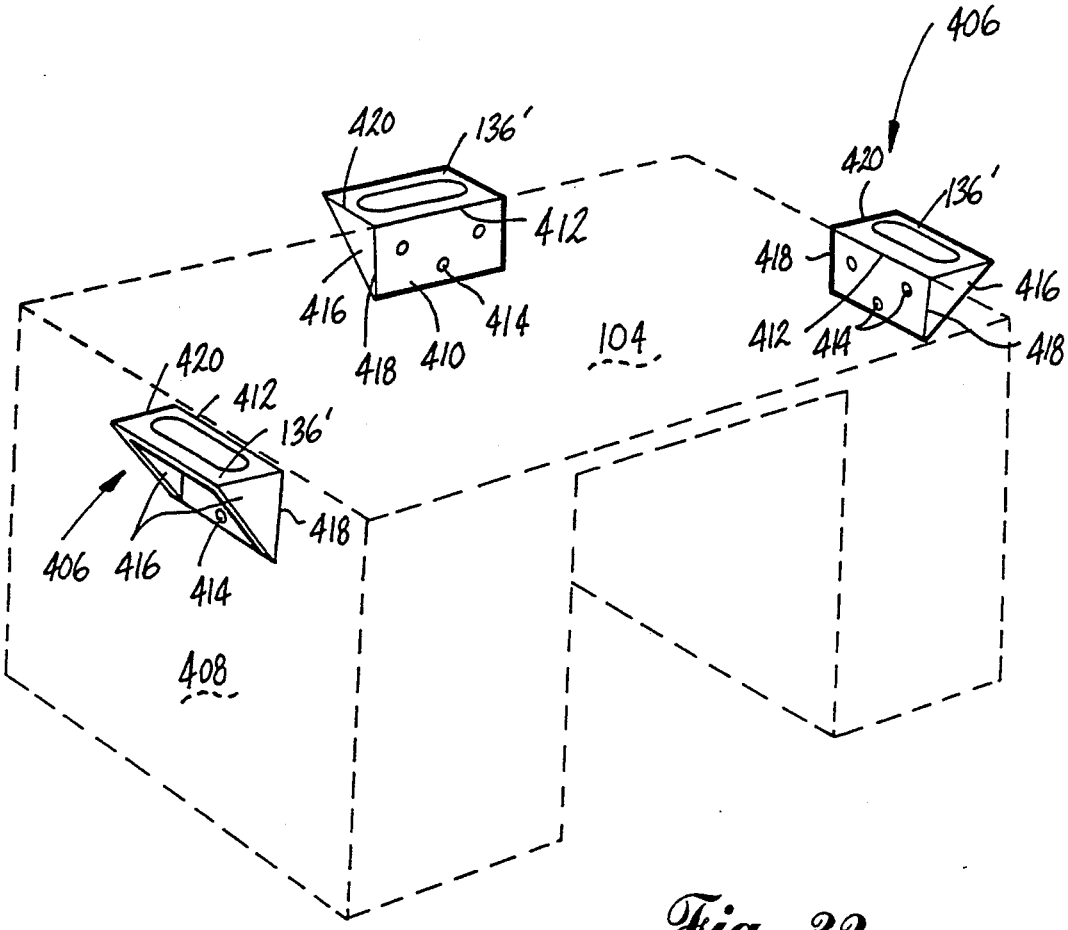
FIG. 32 illustrates an alternative mounting arrangement for a terminal center according to the invention.

In some applications it is not desirable to provide a slot 122 in the work surface as shown in FIG. 7. In such instance, an arrangement illustrated in FIG. 32 may substitute. FIG. 32 illustrates a number of stationary upper housings 406 identical to the stationary upper housing 128, with the exception that they are adapted to mount to a vertical side surface 408. The horizontally disposed collar 136 on the stationary upper housing 406 is essentially rectangular in shape and a vertically oriented mounting panel 410 depends from one of the longer edges 412 thereof. Mounting apertures 414 are provided in the mounting panel 410 so that the stationary upper housing 406 may be screwed into the vertical side surface 408. Also, triangular shaped gusset panels 416 extend between vertical edges 418 of the mounting panel 410, and short edges 420 of the horizontally disposed collar 136'. Of course, other even less damaging means, such as C-clamps or the like, may be provided for affixing a stationary upper housing such as the stationary upper housing 406 or the stationary upper housing 128 to a work surface, or other desired location.

It will be apparent to those skilled in the pertinent arts that still other embodiments of communications terminal centers in accordance with the invention can be designed. That is, the principles of a manually operable and retractable communications terminal center are not limited to the specific embodiments described herein. For example, mechanisms other than that described herein can be employed to rigidly secure the stationary housing 128 to the work surface 104. Accordingly, it will be apparent to those skilled in the art that modifications and other variations of the above-described illustrative embodiments of the invention may be effected without departing from the spirit and scope of the novel concepts of the invention.

The embodiments of the invention in which an exclusive property or privilege is claimed are defined as follows:

1. An energy center adapted to be mounted to a desk or other furniture item having a work surface, said energy center comprising:

stationary housing means;

lighting means for providing illumination in the vicinity of said energy center;

carriage means received within said housing means for mounting said lighting means so as to be vertically moveable with respect to said housing means between a closed, retracted position and an extended, open position;

first support means mounted to said carriage means for supporting said carriage means in said extended, open position, said first support means abutting said housing means when said carriage means is supported in said extended, open position; and pivot means coupled to said lighting means and to said carriage means for providing positional adjustment of said lighting means relative to said carriage means.

2. An energy center in accordance with claim 1 characterized in that:

said work surface comprises a slot formed in said work surface;

said stationary housing means is adapted to be mounted within said slot; and said lighting means is substantially hidden from view below said work surface when said carriage means is in said closed, retracted position.

3. An energy center in accordance with claim 1 characterized in that:

said work surface includes side or edge portions; and said stationary housing means is mounted to said work surface adjacent said side or edge portions.

4. An energy center in accordance with claim 1 characterized in that said energy center further comprises second support means mounted to said carriage means for supporting said carriage means at at least one vertically extended position intermediate said closed, retracted position and said extended, open position.

5. An energy center in accordance with claim 1 characterized in that said energy center further comprises limit means engagable with said pivot means for limiting positional adjustment of said lighting means relative to said carriage means.

6. An energy center in accordance with claim 1 characterized in that said energy center further comprises locking means engagable with said lighting means for maintaining said lighting means in a pivoted position relative to said carriage means.

7. An energy center in accordance with claim 1 characterized in that:

said stationary housing means includes an aperture through which said carriage means is extendable; and said lighting means and said carriage means form a substantially enclosed cover on said aperture when said carriage means is in a closed, retracted position.

8. An energy center in accordance with claim 1 characterized in that:

said stationary housing means includes an aperture through which said carriage means is extendable; and said energy center further comprises a cover mounted to said carriage means which provides at least a partial cover over said aperture when said carriage means is extended to a position other than said closed, retracted position.

9. An energy center in accordance with claim 1 characterized in that said lighting means is pivotable through said pivot means by a single axis between a closed position and an open position, wherein said lighting means in its open position is at an angle of 90° relative to said closed position.

10. An energy center in accordance with claim 9 characterized in that said single axis is perpendicular to vertical movement of said carriage means.

11. An energy center in accordance with claim 1 characterized in that said lighting means is pivotable through said pivot means by a single axis between a closed position and an open position, wherein said lighting means in its open position is at an angle in the range of 90° to 180° relative to said closed position.

12. An energy center in accordance with claim 1 characterized in that said pivot means comprises two orthogonal pivot axes, and said lighting means is pivotable about said orthogonal axes.

13. An energy center in accordance with claim 12 characterized in that each of said two orthogonal pivot axes is perpendicular to vertical movement of said carriage means.

14. An energy center in accordance with claim 1 characterized in that said pivot means comprises means for providing spherical rotation of said lighting means relative to said carriage means.

15. An energy center in accordance with claim 1 characterized in that:

said carriage means comprises a pair of carriages, each of said carriages adjacent to the other of said carriages, received within said housing means and vertically movable with respect to said housing means between a closed, retracted position and an extended, open position; and said lighting means comprises a pair of lighting devices, each of said lighting devices coupled to a different one of said carriages through said pivot means and pivotably adjustable relative to its corresponding carriage.

16. An energy center in accordance with claim 1 characterized in that said energy center further comprises energizing means connected to said lighting means and extending through said carriage means for selectively connecting said lighting means to a source of external power.

17. An energy center adapted to be mounted to a desk or other furniture item having a work surface with a slot extending therethrough, said energy center comprising:

a stationary housing mounted within said slot and having an aperture therethrough;

an elongated carriage received within said aperture and vertically movable with respect to said housing between a closed, retracted position and an extended, open position;

detent means between side walls of said carriage and said housing for selectively maintaining said carriage in said extended, open position; and a lighting element interconnected with an upper portion of said carriage for selectively providing illumination in the vicinity of said energy center, said lighting being substantially hidden from view below an upper portion of said work surface when said carriage is in said closed, retracted position, and said lighting element being fully accessible to a user when said carriage is in said extended, open position.

18. An energy center in accordance with claim 17 characterized in that said energy center further comprises a first pivot element coupled to said lighting element and said carriage, so as to provide pivotable rotation of said lighting element relative to said carriage about at least a single axis of rotation when said carriage is in said extended, open position.

19. An energy center in accordance with claim 17 characterized in that said energy center further comprises:

a first pivot element coupled to said lighting element and to said carriage and extending in an elongated manner so as to form a pitch axis of rotation for said lighting element relative to said carriage; and a second pivot element coupled to said lighting element and to said carriage and extending perpendicular to said first pivot element for providing a roll axis of rotation for said lighting element relative to said carriage.

20. An energy center in accordance with claim 17 characterized in that said energy center further comprises a pivot element coupled to said lighting element and to said carriage and extending parallel to said vertical movement of said carriage for providing a yaw axis of rotation for said lighting element relative to said carriage.

21. An energy center in accordance with claim 17 characterized in that said energy center further comprises:

a second carriage received within said aperture, positioned adjacent and parallel to said carriage and vertically movable with respect to said housing between a closed, retracted position and an extended, open position; and a second lighting element interconnected with an upper portion of said second carriage for providing additional illumination in the vicinity of said energy center, said second lighting element being substantially hidden from view below an upper portion of said work surface when said second carriage is in said closed, retracted position, and said second lighting element being fully accessible to a user when said carriage is in said extended, open position.

22. An energy center in accordance with claim 6 wherein said locking means comprises a leg extending between said lighting means and said work surface.

23. An energy center in accordance with claim 6 wherein said locking means comprises a support bracket between said lighting means and said carriage means.

24. An energy center in accordance with claim 23 wherein said support bracket comprises a support bar pivotably connected to said lighting means at one end and having a plurality of engagement means at an opposite end thereof, the carriage further comprising a receiving means for selectively receiving one of said engaging means whereby said support bracket supports said lighting means at a multitude of angles with respect to said carriage means, the angles being selectable by the user.

25. An energy center in accordance with claim 6 wherein said locking means comprises a friction hinge between said lighting means and said carriage means.

26. An energy center in accordance with claim 25 wherein said friction hinge further comprises a first portion attached to said carriage means and a second portion attached to said lighting means, each of said tint and second portions having apertures therethrough, and a pin means is receivable through said apertures in said first portion and said second portion for rotatively and compressively connecting said first portion and said second portion, and each of said first portion and said second portion further comprises a friction enhancement thereon, said friction enhancements engageable with each other for enhancing the frictional interconnection between said first portion and said second portion.

27. An energy center in accordance with claim 26 wherein said friction enhancements comprise outwardly extending ridges.

* * * * *

UNITED STATES PATENT AND TRADEMARK OFFICE

CERTIFICATE OF CORRECTION

PATENT NO. : 5,351,173

DATED : September 27, 1994

INVENTOR(S) : NORMAN R. BYRNE

It is certified that error appears in the above-identified patent and that said Letters Patent is hereby corrected as shown below:

Column 22, claim 26, line 44:
delete "tint" and insert "first"

Signed and Sealed this

Fifteenth Day of November, 1994

*Attest:*

*Attesting Officer*

BRUCE LEHMAN

*Commissioner of Patents and Trademarks*